US010413150B2

(12) United States Patent
Taylor et al.

(10) Patent No.: US 10,413,150 B2
(45) Date of Patent: Sep. 17, 2019

(54) CLEANING MOP FRAME AND CLEANING IMPLEMENT

(71) Applicant: AVINTIV Specialty Materials Inc., Charlotte, NC (US)

(72) Inventors: James Taylor, Barcelona (ES); Mark Hoyle, Winchester, VA (US); Brad Forrest, Cary, NC (US); Thomas Perelli, Raleigh, NC (US)

(73) Assignee: AVINTIV Specialty Materials, Inc., Charlotte, NC (US)

( * ) Notice: Subject to any disclaimer, the term of this patent is extended or adjusted under 35 U.S.C. 154(b) by 284 days.

(21) Appl. No.: 15/357,009

(22) Filed: Nov. 21, 2016

(65) Prior Publication Data

US 2017/0143179 A1 May 25, 2017

Related U.S. Application Data

(60) Provisional application No. 62/257,363, filed on Nov. 19, 2015.

(51) Int. Cl.

| | |
|---|---|
| ***A47L 13/258*** | (2006.01) |
| ***A47L 13/256*** | (2006.01) |
| ***A47L 13/46*** | (2006.01) |

(52) U.S. Cl.

CPC ..... *A47L 13/258* (2013.01); *A47L 13/256* (2013.01); *A47L 13/46* (2013.01)

(58) Field of Classification Search

CPC .... A47L 13/254; A47L 13/256; A47L 13/258; A47L 13/44; A47L 13/46

(Continued)

(56) References Cited

U.S. PATENT DOCUMENTS 3,737,938 A * 6/1973 Saltzstein ..... A47L 13/256 15/231
5,410,772 A * 5/1995 Lewis ..... A47L 13/20 15/106

(Continued)

FOREIGN PATENT DOCUMENTS

DE 10350997 B3 12/2004
EP 3376929 A1 9/2018

(Continued)

OTHER PUBLICATIONS

Invitation to Pay Additional Fees and, Where Applicable, Protest Fee as issued in corresponding International Application No. PCT/US2016/063042, dated Mar. 3, 2017, all pages cited.

(Continued)

*Primary Examiner* — Laura C Guidotti
(74) *Attorney, Agent, or Firm* — Burr Forman McNair LLP

(57) ABSTRACT

Cleaning mop frames structurally configured to provide a more even distribution of floor soil across a surface of a wiper attached to such mop frames are provided. The mop frames include a central body portion, a top surface, a bottom surface, opposed side edges, and opposed front and rear edges. The mop frame may also include at least one retaining structure configured to releasably attach a cleaning fabric proximate to or adjacent to at least the bottom surface of the mop frame. Cleaning implements including a mop frame, a yoke assembly, and a multi-pivoting hinge attached to and connecting the mop frame and the yoke assemble are also provided. The multi-pivoting hinge being configured to allow the yoke assembly to selectively swing from a top surface to a bottom surface of the mop frame or vice versa.

21 Claims, 7 Drawing Sheets

(58) Field of Classification Search
USPC ..... 15/231
See application file for complete search history.

(56) References Cited

U.S. PATENT DOCUMENTS

| | | | | |
|---|---|---|---|---|
| 7,496,985 | B1 | 3/2009 | Morad | |
| 2007/0006413 | A1* | 1/2007 | Lee | A47L 13/24 15/228 |
| 2009/0139045 | A1 | 6/2009 | Cannon et al. | |

FOREIGN PATENT DOCUMENTS

| | | | |
|---|---|---|---|
| WO | 2010114207 | A1 | 10/2010 |
| WO | 2012162590 | A1 | 11/2012 |
| WO | 2017087938 | A1 | 5/2017 |

OTHER PUBLICATIONS

Second Written Opinion of the International Preliminary Examining Authority of corresponding International Application No. PCT/US2016/063042 dated Feb. 23, 2018, all enclosed pages cited.
Second Written Opinion of corresponding international application No. PCT/US2016/063042 dated Oct. 12, 2017, all enclosed pages cited.
International Search Report and Written Opinion of corresponding International Application No. PCT/US2016/063042 dated Apr. 13, 2017, all enclosed pages cited.
Office Action issued in Canadian Patent Application No. 3,005,881 dated Feb. 25, 2019, all enclosed pages cited.

* cited by examiner

CLEANING MOP FRAME AND CLEANING IMPLEMENT

PRIORITY CLAIM

This application claims priority under 35 U.S.C. § 119(e) to U.S. Provisional Application Ser. No. 62/257,363, filed on Nov. 19, 2015, which is expressly incorporated by reference herein in its entirety.

TECHNICAL FIELD

The invention relates generally to reusable cleaning mop frames structurally configured to improve and/or facilitate a more even distribution of floor debris (e.g., soil and/or dirt) across a surface of a wiper material attached to such mop frames. The invention also relates generally to reusable cleaning implements including such structurally configured mop frames and at least a handle directly or indirectly attached to the mop frame.

BACKGROUND

A common configuration of a disposable wiper on a flat frame includes having one of the wiper's side positioned up against a relatively smooth bottom surface of the flat frame. If the bottom surface of the flat frame is not completely smooth, the bottom surface of the flat frame may have raised protrusions or "dimples" that may be used as a scrubbing aid or to help keep the media (e.g., disposable wiper) stationary. The common manner for attaching a disposable wiper is by pressing the material into a "star" type feature/geometry located at each corner of the flat frame. The "star" shape is simply a few flexible plastic arrow-type pointed segments that converge toward a center. The arrow-type pointed segments are made by thru-cuts in a plastic part. Each "star" type feature is typically located on the top surface of the flat frame at each of the corners and a portion of the disposable wiper is inserted through the "star" type feature and into a hole in the flat frame. These holes in the frame, which are covered by the "star" type feature, can easily collect and retain dirt.

Due to the structural configuration of these "star" type features covering the holes for receiving wiper material, there is no easy way to clean and/or remove dirt unless the "star" type feature can be removed. Also, with the star's arrow-type pointed segments basically touching each other, rinsing out with water is ineffective. An additional shortcoming with the "star" type feature is that the media (e.g., wiper material) is not attached to the frame across a significant length of the flat frame (e.g., the entire length of the flat frame). This, in turn, can have the wiper material mounted too loosely and sloppy looking in appearance. Additionally, the wiper material needs to overlap the flat frame significantly to lock securely within the "star" type feature.

Using the common method of wiper-attachment with the "star" type feature positioned on a top section of the frame in each corner, the media (e.g., disposable wiper) is stationary against the bottom smooth or semi-smooth surface of the flat frame. As a user cleans a floor, either wet or dry cleaning (dusting), the debris (e.g., soil and/or dirt) will almost always undesirably build-up on the front leading edge of the flat frame. When removing the wiper from the flat frame, through visual examination, a user can clearly see that the wiper has a line of debris (e.g., soil and/or dirt) on the outside of the wiper and the material of the wiper appears significantly cleaner towards the inside of the wiper. Accordingly, a majority of the wiper material has not been sufficiently utilized for the collection and removal of debris (e.g., soil and/or dirt) from surfaces to be cleaned. This approach is an inefficient way to clean since the wiper is designed to collect and/or hold the debris (e.g., soil and/or dirt), but a majority of the wiper has not been sufficiently used for collection of debris (e.g., soil and/or dirt). For instance, most of the wiper is not being used to collect and/or hold debris (e.g., soil and/or dirt) as the debris (e.g., soil and/or dirt) is only collected and built-up along the wiper's long edge, and not the internal portion of the wiper. Additionally, such an approach simply wastes a significant amount of viable wiper material. That is, wiper materials are generally engineered to hold and/or collect the debris (e.g., soil and/or dirt), but most of the wiper material is not be used to full or even near cleaning capacity (e.g., the wiper material in the central portion of the wiper positioned on traditional flat fames is thrown away without first collecting and/or holding any significant amount of debris).

Two-sided flat mops have come into the market years after the single-sided flat mop has been well established throughout much of the global marketplace. The commercial cleaning industry like many others continually look for ways to improve the efficiency of their chemicals and tools. The two-sided mop is one such tool. Having either a disposable or reusable wiper material fixed to two sides (top and bottom), allows the user to clean more floor area faster because they are reducing the number of trips to, for example, a clean cart to access a replacement clean wiper.

As just described, this is an efficiency improvement to the user's cleaning process. However, it has been identified through limited testing of two-sided flat mops themselves that there is a problem with some current two-sided designs. These problematic designs have a yoke assembly that is attached to one long edge of the mop frame. This assembly can rotate 180 degrees allowing the mop frame to be used on both sides, in turn, the ability to clean with two mop surfaces alternately. The problem identified is that the yoke's hinge does not extend out far enough to allow the yoke to be centered within the mop frame. This design is typically used in a cleaning figure-eight motion by pulling the mop where the yoke hinge would extend just past the mops leading edge. This method is not as efficient as a single-sided frame where the yoke is centered within the frame. For efficient cleaning, the user will use both push had pull motions for different areas of cleaning. For large open areas the figure-eight method of pulling the mop is used. For hard to clean areas and targeted spot cleaning a push force is used.

The foregoing two-sided configuration just described is not efficient when pushing because the user's push force that is emitted down the length of the mop handle is not centered over the mop distributing the downward force evenly over the mop frame, in turn, a force being applied directly over a targeted soiled surface. For the single-sided frame, however, the centrally located yoke (as mentioned) at the center of the downward force distributes its force out fairly evenly because the frame is ridged. The radiating force from center, however, does dissipate as it gets out toward the frames edges, but is still more efficient when applying a force over the mop as oppose to pulling the mop over the floor as mentioned.

Therefore, there at least remains a need in the art for an improved mop frame (e.g., a flat mop frame) configured for providing a more even distribution of debris (e.g., soil and/or dirt) across a surface of a wiper material from a surface being cleaned. Also, there at least remains a need in the art for an improved mop frame (e.g., a flat mop frame) which provides an improved attachment structure for engaging and releasably holding a wiper material onto the mop frame. There is additionally a need for dual-sided mop frame that enables improved efficiency in cleaning.

SUMMARY OF INVENTION

One or more embodiments of the invention may address one or more of the aforementioned problems. Certain embodiments, according to the invention, provide mop frames (e.g., a flat mop frame) structurally configured to improve and/or facilitate a more even distribution of floor debris (e.g., soil and/or dirt) across a surface of a wiper attached to such mop frames and cleaning implements including such mop frames. In one aspect, certain embodiments of the invention provides a mop frame comprising a central body portion, a top surface, a bottom surface, diametrically opposed side edges, and diametrically opposed front and rear edges. Certain embodiments of the invention may comprise at least one frontal recessed portion extending from the front edge towards the central body portion, wherein the at least one frontal recessed portion defines a front open area along the length of the front edge. In accordance with certain embodiments of the invention, the mop fame may also comprise at least one rearward recessed portion extending from the rear edge towards the central body portion, wherein the at least one rearward recessed portion defines a rear open area along the length of the rear edge. Mop frames, according to certain embodiments of the invention, may comprise at least one retaining structure configured to releasably attach a cleaning fabric proximate to or adjacent to at least the bottom surface.

In accordance with certain embodiment of the invention, the at least one frontal recessed portion may comprise a first frontal recessed portion and the at least one rearward recessed portions may comprise a first rearward recessed portion, wherein each of the first frontal recessed portion and the first rearward recessed portion comprises a top wall and at least one side wall. In certain embodiments of the invention, for example, the top wall may be substantially parallel to the bottom surface while in other embodiments the top wall may not be substantially parallel to the bottom surface of the mop frame. Certain embodiments of the invention may comprise at least one side wall (or all side walls) being substantially perpendicular to the bottom surface. In other embodiments of the invention, at least one side wall (or all side walls) may not be substantially perpendicular to the bottom surface of the mop frame. In accordance with certain embodiments of the invention, for example, the at least one frontal recessed portion may comprise a variable cross-section including a first frontal recessed portion cross-section proximate to and parallel with the front edge of the mop frame and a second frontal recessed portion cross-section distal from and parallel with the front edge of the mop frame, in which the first frontal recessed portion cross-section may be larger than the second frontal recessed portion cross-section. Similarly, certain embodiments of the invention may also comprise at least one rearward recessed portion comprising a variable cross-section including a first rearward recessed portion cross-section proximate to and parallel with the rear edge of the mop frame and a second rearward recessed portion cross-section distal from and parallel with the rear edge, in which the first rearward recessed portion cross-section may be larger than the second rearward recessed portion cross-section. In accordance with certain embodiments of the invention, the mop frame may comprise from about 1 to about 10 frontal recessed portions and/or from about 1 to about 10 rearward recessed portions.

Certain embodiments according to the invention, the front edge of the mop frame may comprise a front edge height defined by a front length extending from the bottom surface of the mop frame to the top surface of the mop frame and the at least one side wall of the first frontal recessed portion defines, at least in part, a first frontal recessed portion depth. In accordance with certain embodiments of the invention, the first frontal recessed portion depth may be less than the front edge height. In addition are alternatively to, certain embodiments of the invention may include a rear edge comprising a rear edge height defined, at least in part, by a rear length extending from the bottom surface of the mop frame to the top surface of the mop frame and the at least one side wall of the first rearward recessed portion defines, at least in part, a first rearward recessed portion depth. In accordance with certain embodiments of the invention, the first rearward recessed portion depth may be less than the rear edge height. Mop frames, according to certain embodiments of the invention, comprise at least a first frontal recessed portion depth comprising a variable depth including an outer depth proximate to the front edge of the mop frame and an inner depth distal from the front edge of the mop frame, in which the outer depth may be larger than the inner depth. The first rearward recessed portion depth, according to certain embodiments of the invention, may comprise a variable depth including an outer depth proximate to the rear edge of the mop frame and an inner depth distal from the rear edge of the mop frame, in which the outer depth may be larger than the inner depth.

Mop frames, according to certain embodiments of the invention, may further comprise a plurality of angular fin projections located within at least the first frontal recessed portion and the first rearward recessed portion. In accordance with certain embodiments of the invention, each of the at least one frontal recessed portions and each of the at least one rearward recessed portions may include a plurality of angular fin projections located therein, in which (for example) each of the angular fin projections extend from each corresponding top wall. The plurality of angular fin projections, according to certain embodiments of the invention, located within at least the first frontal recessed portion comprises a first pair (e.g. two complementary arrays of angular fin projections) of arrays configured in a converging pattern. In accordance with certain embodiments of the invention, the pair of arrays includes a first array of individual angular fin projections and a second array of individual angular fin projections, wherein (for example) each of the individual angular fin projections being oriented at an angle from between about 5 to about 85 degrees from a longitudinal axis of the mop frame. The individual angular fin projections of at least the first array, for example, may be equidistantly spaced apart from each other. Each of the plurality of angular fin projections located within at least the first frontal recessed portion and the first rearward recessed portion, according to certain embodiments of the invention, may comprise a base end adjacent the corresponding top wall and extend towards the bottom surface of the mop frame and terminate at a tip end located at or proximate a bottom plane including the bottom surface of the mop frame. In accordance with certain embodiments of the invention, the plurality of angular fin projections may comprise a flexible polymeric material. The plurality of angular fin projections, according to certain embodiments of the invention, may comprise a first thickness at the base end and a second thickness at the tip end, in which the first thickness may be larger than the second thickness.

As noted above, certain embodiments of the invention may comprise at least one retaining structure comprising, for example, a first channel being open in an upwardly facing direction and comprising an open section located at or proximate the top surface of the mop frame. For example, the first channel may be configured for receiving a portion of a cleaning fabric (e.g., a wiper material) and may comprise a first flexible pointed protrusion configured to engage and releasably secure the portion of the cleaning fabric within the first channel. In accordance with certain embodiments, the first flexible pointed protrusion may be located at or proximate the open section of the first channel. In accordance with certain embodiments of the invention, the first channel may be located at or proximate to the front edge of the mop frame. The first channel, according to certain embodiments of the invention, may extend along about 50% to 100% of a longitudinal length of the mop frame. In still further embodiments of the invention, the mop frame may further comprise a second channel being open in an upwardly facing direction and comprising a second open section located at or proximate the top surface. In certain embodiments of the invention, the second channel may be configured for receiving a second portion of the cleaning fabric and comprising a second flexible pointed protrusion configured to engage and releasably secure the second portion of the cleaning fabric within the second channel. In accordance with certain embodiments of the invention, the second flexible pointed protrusion may be located at or proximate the second open section of the second channel. In accordance with certain embodiments of the invention, the second channel may be located at or proximate to the rear edge of the mop frame and the second channel may extend along about 50% to 100% of the longitudinal length of the mop frame.

In accordance with certain embodiments of the invention, the at least one retaining structure may comprise a first channel being open in a frontward facing direction and comprising an open section located at the front edge of the mop frame, in which the first channel may be configured for receiving a portion of a cleaning fabric (e.g., a wiper material) and comprising a first flexible pointed protrusion configured to engage and releasably secure the portion of the cleaning fabric within the first channel. In accordance with certain embodiments of the invention, the first channel may extend along about 50% to 100% of a longitudinal length of the mop frame. In accordance with certain embodiments of the invention, the first flexible pointed protrusion may be located at or proximate the open section of the first channel. According to still further embodiments of the invention, the at least one retaining structure may further comprise a second channel being open in a rearward facing direction and comprising a second open section located at the rear edge of the mop frame. The second channel, according to certain embodiments of the invention, may be configured for receiving a second portion of the cleaning fabric and comprise a second flexible pointed protrusion configured to engage and releasably secure the second portion of the cleaning fabric within the second channel. In accordance with certain embodiments of the invention, the second channel may extend along about 50% to 100% of the longitudinal length of the mop frame. In accordance with certain embodiments of the invention, the second flexible pointed protrusion may be located at or proximate the second open section of the second channel.

Mop frames in accordance with certain embodiments of the invention, may comprise at least one retaining structure comprising a generally S-shaped channel structure. The S-shaped channel structure, for example, may comprise a first open section located at or proximate the top surface of the mop frame and facing in an upwardly direction and a second open section located at or proximate the bottom surface of the mop frame and facing in an downwardly direction. In accordance with certain embodiments of the invention, the generally S-shaped channel structure may be configured to releasably secure a first portion of a cleaning fabric (e.g., a wiper material) within the first open section and releasably secure a second portion of a cleaning fabric within the second open section.

Mop frames, according to certain embodiments of the invention, may comprise an integrally molded structure (e.g., formed as a single unitary piece). In accordance with certain embodiments of the invention, the mop frame may comprise a polymer, a biodegradable polymer, a biocomposite, or any combination thereof. In accordance with certain embodiments of the invention, the polymer may comprise at least one of an extruded thermoplastic polymer, an extruded thermoset polymer, a mold-formed thermoplastic polymer, a mold-formed thermoset polymer, or any combination thereof. In accordance with certain embodiments of the invention, the polymer may comprise at least one of a polyethylene, a polypropylene, a partially aromatic polyester, a fully aromatic polyester, a polyhexamethylene diadipamide, a polycaprolactam, an aromatic polyamide, a partially aromatic polyamide, an aliphatic polyamide, or any combination thereof. In accordance with certain embodiments of the invention, the biodegradable polymer may comprise at least one of a cellulose, a polylactic acid, a cellophane, a native starch, a thermoplastic starch, a polyhydroxy butyrate, a poly-hydroxybutyrate-co-b-hydroxy valerate, a polyglycolic acid, a polycaprolactone, a compostable bioplastic, a platinum-catalyzed silicone, a reclaimed potato starch resin, or any combination thereof.

In another aspect the invention provides a cleaning implements including a mop frame, a yoke assembly, and a handle portion, in which the yoke assembly may be configured to connect the mop frame to the handle portion. In this regard, certain embodiments of the invention may comprise a cleaning implement including a handle portion, a yoke assembly, and a mop frame according to any of the mop frames according to embodiments of the invention disclosed herein. In certain embodiments of the invention, the yoke assembly may be configured to engage and secure both the handle portion and the mop frame to form the cleaning implement. In accordance with certain embodiments of the invention, the yoke assembly may comprise a lockable point hinge.

In accordance with certain embodiments of the invention, the cleaning implements may comprise (i) a mop frame including a top surface and a bottom surface; (ii) a yoke assembly configured to engage and secure a handle portion; and (iii) a multi-pivoting hinge attached to and connecting the mop frame and the yoke assemble. In accordance with certain embodiments of the invention, the multi-pivoting hinge may be configured to allow the yoke assembly to selectively (e.g., upon the desire and/or action of a user) swing from the top surface to the bottom surface of the mop frame. In accordance with certain embodiments of the invention, the multi-pivoting hinge may comprise a first rotational axis, a second rotational axis, and a third rotational axis, in which upon selectively (e.g., upon the desire and/or action of a user) swinging the yoke assembly from the top surface to the bottom surface or vice versa (i) the third rotational axis remains stationary relative to the mop frame, (ii) the second rotational axis rotates about the third rotational axis, and (iii) the first rotational axis rotates about the second rotational axis. The multi-pivoting hinge, in accordance with certain embodiments of the invention, may comprise an upper joint configured to selectively overlie (e.g., directly or indirectly) the top surface and/or the bottom surface of the mop frame depending on the selected position of the yoke assembly relative to the mop frame, in which the upper joint comprises an upper-joint length such that the handle portion is centrally located over the mop frame. In accordance with certain embodiments of the invention, the upper joint may comprise an attachment mechanism configured to releasably engage the yoke assembly to a centrally located portion of the mop frame.

In another aspect, the invention provides a method of manufacturing a mop frame. Certain embodiment of the invention, for example, may comprise an optional step of preparing a flowable polymeric melt composition and forming a substantially flat body portion, in which the flat body portion may comprise a central body portion, a top surface, a bottom surface, diametrically opposed side edges, and diametrically opposed front and rear edges. Certain embodiments of the invention, for example, may comprise a step of forming at least one frontal recessed portion extending from the front edge towards the central body portion, in which the at least one frontal recessed portion defines a front open area along the length of the front edge, and forming at least one rearward recessed portion extending from the rear edge towards the central body portion, wherein the at least one rearward recessed portion defines a rear open area along the length of the rear edge. In accordance with certain embodiments of the invention, the method may also comprise a step of forming at least one retaining structure configured to releasably attach a cleaning fabric proximate to or adjacent to at least the bottom surface and/or a step of forming a plurality of angular fin projections.

In accordance with certain embodiments of the invention, the step of forming the substantially flat body portion may comprise an injection molding process, an extrusion process, or a three-dimensional (3D) printing process. In accordance with certain embodiments of the invention, the step of forming the at least one frontal recessed portion, the at least one rearward recessed portion, the at least one retaining structure, or any combination thereof comprises an injection molding process, an extrusion process, or a three-dimensional (3D) printing process. In accordance with certain embodiments of the invention, each of the at least one frontal recessed portion, the at least one rearward recessed portion, the at least one retaining structure may be formed as a single unitary component by an injection molding process, an extrusion process, or a three-dimensional (3D) printing process. In accordance with certain embodiments of the invention, the method may comprise a step of forming a plurality of angular fin projections in which the step of forming each of the plurality of angular fin projections comprises an injection molding process, an extrusion process, or a three-dimensional (3D) printing process. Methods of manufacturing a mop frame, according to certain embodiments of the invention, may comprise filling a die or mold with the flowable polymeric melt composition and curing the flowable polymeric melt composition to provide a solid polymeric composition. In this regard, the mop frame manufactured according to certain embodiments of the invention may comprise a unitary structure (e.g., formed as one single piece and being devoid of any attachment articles such as screws, bolts, clips or the like) or as an assembled structure, in which the individual components may be releasable engaged, such as by screws, bolts, clips and the like, with each other to form an assembled mop frame. In accordance with certain embodiments of the invention, the at least one frontal recessed portion may include a first frontal recessed portion and the at least one rearward recessed portions may include a first rearward recessed portion, in which each of the first frontal recessed portion and the first rearward recessed portion comprises a top wall and at least one side wall.

In certain embodiments of the invention, for example, the top wall may be substantially parallel to the bottom surface while in other embodiments the top wall may not be substantially parallel to the bottom surface of the mop frame. Certain embodiments of the invention may comprise at least one side wall (or all side walls) being substantially perpendicular to the bottom surface. In other embodiments of the invention, at least one side wall (or all side walls) may not be substantially perpendicular to the bottom surface of the mop frame. In accordance with certain embodiments of the invention, for example, the at least one frontal recessed portion may comprise a variable cross-section including a first frontal recessed portion cross-section proximate to and parallel with the front edge of the mop frame and a second frontal recessed portion cross-section distal from and parallel with the front edge of the mop frame, in which the first frontal recessed portion cross-section may be larger than the second frontal recessed portion cross-section. Similarly, certain embodiments of the invention may also comprise at least one rearward recessed portion comprising a variable cross-section including a first rearward recessed portion cross-section proximate to and parallel with the rear edge of the mop frame and a second rearward recessed portion cross-section distal from and parallel with the rear edge, in which the first rearward recessed portion cross-section may be larger than the second rearward recessed portion cross-section. In accordance with certain embodiments of the invention, the mop frame may comprise from about 1 to about 10 frontal recessed portions and/or from about 1 to about 10 rearward recessed portions.

In accordance with certain method embodiments to the invention, the front edge of the mop frame may comprise a front edge height defined by a front length extending from the bottom surface of the mop frame to the top surface of the mop frame and the at least one side wall of the first frontal recessed portion defines, at least in part, a first frontal recessed portion depth. In accordance with certain embodiments of the invention, the first frontal recessed portion depth may be less than the front edge height. In addition are alternatively to, certain embodiments of the invention may include a rear edge comprising a rear edge height defined, at least in part, by a rear length extending from the bottom surface of the mop frame to the top surface of the mop frame and the at least one side wall of the first rearward recessed portion defines, at least in part, a first rearward recessed portion depth. In accordance with certain embodiments of the invention, the first rearward recessed portion depth may be less than the rear edge height. According to certain method embodiments of the invention, the produced mop fames may comprise at least a first frontal recessed portion depth comprising a variable depth including an outer depth proximate to the front edge of the mop frame and an inner depth distal from the front edge of the mop frame, in which the outer depth may be larger than the inner depth. The first rearward recessed portion depth, according to certain embodiments of the invention, may comprise a variable depth including an outer depth proximate to the rear edge of the mop frame and an inner depth distal from the rear edge of the mop frame, in which the outer depth may be larger than the inner depth.

According to certain method embodiments of the invention, the produced mop frames may further comprise a plurality of angular fin projections located within at least the first frontal recessed portion and the first rearward recessed portion. In accordance with certain embodiments of the invention, each of the at least one frontal recessed portions and each of the at least one rearward recessed portions may include a plurality of angular fin projections located therein, in which (for example) each of the angular fin projections extend from each corresponding top wall. The plurality of angular fin projections, according to certain embodiments of the invention, located within at least the first frontal recessed portion comprises a first pair (e.g. two complementary arrays of angular fin projections) of arrays configured in a converging pattern. In accordance with certain embodiments of the invention, the pair of arrays includes a first array of individual angular fin projections and a second array of individual angular fin projections, wherein (for example) each of the individual angular fin projections being oriented at an angle from between about 5 to about 85 degrees from a longitudinal axis of the mop frame. The individual angular fin projections of at least the first array, for example, may be equidistantly spaced apart from each other. Each of the plurality of angular fin projections located within at least the first frontal recessed portion and the first rearward recessed portion, according to certain embodiments of the invention, may comprise a base end adjacent the corresponding top wall and extend towards the bottom surface of the mop frame and terminate at a tip end located at or proximate a bottom plane including the bottom surface of the mop frame. In accordance with certain embodiments of the invention, the plurality of angular fin projections may comprise a flexible polymeric material. The plurality of angular fin projections, according to certain embodiments of the invention, may comprise a first thickness at the base end and a second thickness at the tip end, in which the first thickness may be larger than the second thickness.

According to certain method embodiments of the invention, the produced mop frames may comprise at least one retaining structure comprising, for example, a first channel being open in an upwardly facing direction and comprising an open section located at or proximate the top surface of the mop frame. For example, the first channel may be configured for receiving a portion of a cleaning fabric (e.g., a wiper material) and may comprise a first flexible pointed protrusion configured to engage and releasably secure the portion of the cleaning fabric within the first channel. In accordance with certain embodiments, the first flexible pointed protrusion may be located at or proximate the open section of the first channel. In accordance with certain embodiments of the invention, the first channel may be located at or proximate to the front edge of the mop frame. The first channel, according to certain embodiments of the invention, may extend along about 50% to 100% of a longitudinal length of the mop frame. In still further embodiments of the invention, the mop frame may further comprise a second channel being open in an upwardly facing direction and comprising a second open section located at or proximate the top surface. In certain embodiments of the invention, the second channel may be configured for receiving a second portion of the cleaning fabric and comprising a second flexible pointed protrusion configured to engage and releasably secure the second portion of the cleaning fabric within the second channel. In accordance with certain embodiments of the invention, the second flexible pointed protrusion may be located at or proximate the second open section of the second channel. In accordance with certain embodiments of the invention, the second channel may be located at or proximate to the rear edge of the mop frame and the second channel may extend along about 50% to 100% of the longitudinal length of the mop frame.

According to certain method embodiments of the invention, the produced mop frames including at least one retaining structure, the at least one retaining structure may comprise a first channel being open in a frontward facing direction and comprising an open section located at the front edge of the mop frame, in which the first channel may be configured for receiving a portion of a cleaning fabric (e.g., a wiper material) and comprising a first flexible pointed protrusion configured to engage and releasably secure the portion of the cleaning fabric within the first channel. In accordance with certain embodiments of the invention, the first channel may extend along about 50% to 100% of a longitudinal length of the mop frame. In accordance with certain embodiments of the invention, the first flexible pointed protrusion may be located at or proximate the open section of the first channel. According to still further embodiments of the invention, the at least one retaining structure may further comprise a second channel being open in a rearward facing direction and comprising a second open section located at the rear edge of the mop frame. The second channel, according to certain embodiments of the invention, may be configured for receiving a second portion of the cleaning fabric and comprise a second flexible pointed protrusion configured to engage and releasably secure the second portion of the cleaning fabric within the second channel. In accordance with certain embodiments of the invention, the second channel may extend along about 50% to 100% of the longitudinal length of the mop frame. In accordance with certain embodiments of the invention, the second flexible pointed protrusion may be located at or proximate the second open section of the second channel.

According to certain method embodiments of the invention, the produced mop frames may comprise at least one retaining structure comprising a generally S-shaped channel structure. The S-shaped channel structure, for example, may comprise a first open section located at or proximate the top surface of the mop frame and facing in an upwardly direction and a second open section located at or proximate the bottom surface of the mop frame and facing in an downwardly direction. In accordance with certain embodiments of the invention, the generally S-shaped channel structure may be configured to releasably secure a first portion of a cleaning fabric (e.g., a wiper material) within the first open section and releasably secure a second portion of a cleaning fabric within the second open section.

According to certain method embodiments of the invention, the produced mop frames may comprise an integrally molded structure (e.g., formed as a single unitary piece). In accordance with certain embodiments of the invention, the mop frame may comprise a polymer, a biodegradable polymer, a biocomposite, or any combination thereof. In accordance with certain embodiments of the invention, the polymer may comprise at least one of an extruded thermoplastic polymer, an extruded thermoset polymer, a mold-formed thermoplastic polymer, a mold-formed thermoset polymer, or any combination thereof. In accordance with certain embodiments of the invention, the polymer may comprise at least one of a polyethylene, a polypropylene, a partially aromatic polyester, a fully aromatic polyester, a polyhexamethylene diadipamide, a polycaprolactam, an aromatic polyamide, a partially aromatic polyamide, an aliphatic polyamide, or any combination thereof. In accordance with certain embodiments of the invention, the biodegradable polymer may comprise at least one of a cellulose, a polylactic acid, a cellophane, a native starch, a thermoplastic starch, a polyhydroxy butyrate, a poly-hydroxybutyrate-co-b-hydroxy valerate, a polyglycolic acid, a polycaprolactone, a compostable bioplastic, a platinum-catalyzed silicone, a reclaimed potato starch resin, or any combination thereof.

Still other objects and features will become apparent from the following detailed description considered in conjunction with the accompanying drawings.

BRIEF DESCRIPTION OF THE DRAW NG(S)

The invention now will be described more fully hereinafter with reference to the accompanying drawings, in which some, but not all embodiments of the invention are shown. Indeed, this invention may be embodied in many different forms and should not be construed as limited to the embodiments set forth herein; rather; these embodiments are provided so that this disclosure will satisfy applicable legal requirements. Like numbers refer to like elements throughout; and wherein.

DETAILED DESCRIPTION

Figure 1:
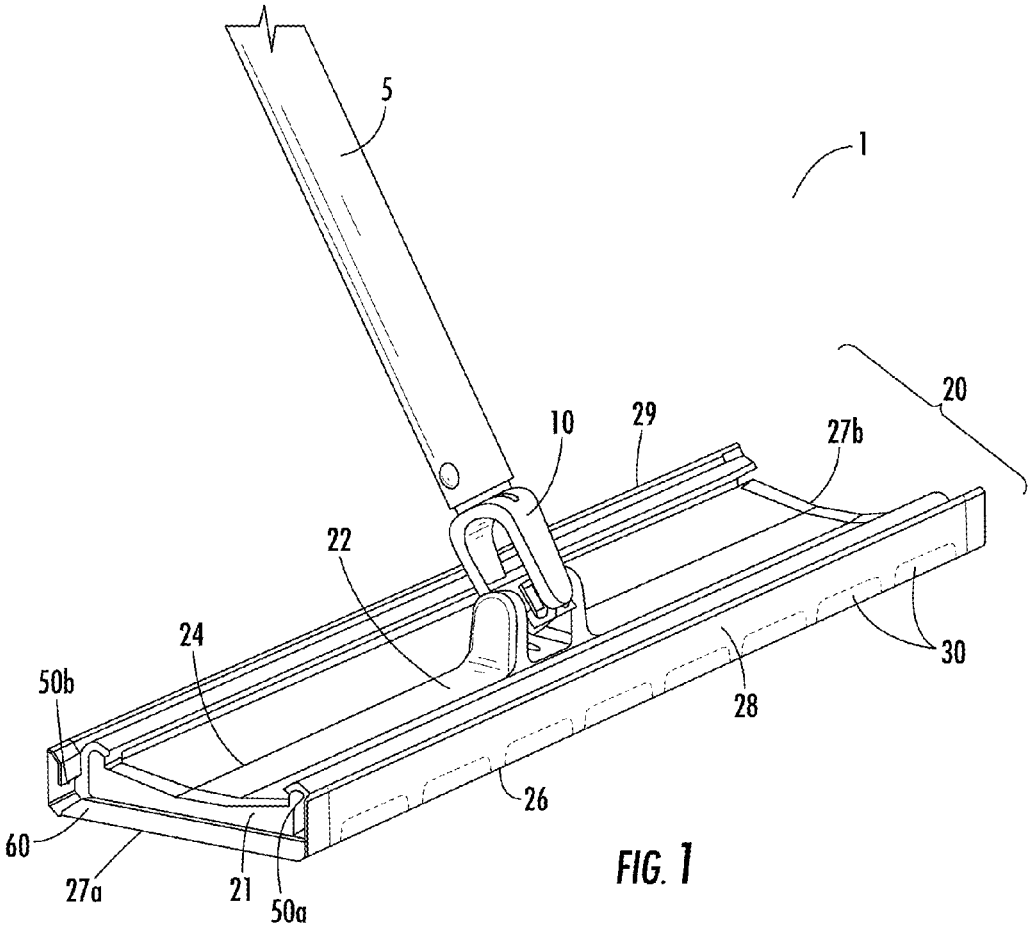
FIG. 1 is an isometric view of a cleaning implement including a flat mop frame having a wiper material attached to the flat mop frame according to an embodiment of the invention.

The invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

It is to be understood, however, that the drawings are designed solely for purposes of illustration and not as a definition of the limits of the invention, for which reference should be made to the appended claims. Any relative dimensions illustrated in the figures are given by way of example and are not intended to be limiting. As would be appreciated by a person having ordinary skill in the art, the relative dimensions can vary depending on any number of factors including, without limitation, the intended use and performance of the illustrated article.

The invention includes, according to certain embodiments, mop frames (e.g., a flat mop frame) structurally configured to improve and/or facilitate a more even distribution of floor debris (e.g., soil and/or dirt) across a surface of a wiper attached to such mop frames and cleaning implements including such mop frames. Certain embodiments of the invention are directed to mop frames including one or more frontal recessed portions defined, at least in part, by a bottom surface and front edge of the mop frame. In accordance with certain embodiments of the invention, the mop frame may also include one or more rearward recessed portions defined, at least in part, by the bottom surface and rear edge of the mop frame. The frontal recessed portion(s) define a font open area, which may either be continuous or an aggregate of a plurality of discrete individual open areas, along the length of the front edge of the mop frame. Similarly, the rearward recessed portion(s) define a rear open area, which may either be continuous or an aggregate of a plurality of discrete individual open areas, along the length of the rear edge of the mop frame. The recessed portions (e.g., the frontal recessed portion(s) and/or the rearward recessed portion(s)) facilitate a more even distribution of debris (e.g., soil and/or dirt) across a wiper material attached to the mop frame when being used to wipe and/or clean a surface, such as a floor. For instance, traditional flat mops typically build-up debris (e.g., soil and/or dirt) along a leading edge of the mop frame preventing the debris (e.g., soil and/or dirt) from collecting evenly across the wiper surface in contact with the surface being cleaned. In accordance with certain embodiments of the invention, the open areas defined by the at least one frontal recessed portion and/or the rearward recessed portion provide a structural configuration to the mop frame that promotes a more even distribution of debris (e.g., soil and/or dirt) by, for example, reducing the build-up of debris (e.g., soil and/or dirt) along a leading edge of the mop frame and enabling more debris (e.g., soil and/or dirt) to be contacted and/or engaged by a larger area the of the wiper material (e.g., the central portion of the wiper material). In certain embodiments of the invention, for example, the recessed portions of the mop frame defining the front open area and/or the rear open area prevents the surface debris (e.g., soil and/or dirt) from building up on the mop frame's leading edge and/or trailing (e.g., rear) edge. In this regard, the surface debris (e.g., soil and/or dirt) has significantly less physical resistant preventing the debris (e.g., soil and/or dirt) from stopping and building up or accumulating when first making contact with the frames leading edge (e.g., the junction of the front edge and the bottom surface of the mop frame), but instead directs or guides the surface debris (e.g., soil and/or dirt) into or towards a central or interior portion of the wiper material. In this regard, the surface debris (e.g., soil and/or dirt) may be directed or guided from portions of the perimeter of the attached wiper material towards the interior portion of the attached wiper material. The recessed portions, according to certain embodiments of the invention, may provide the function and/or enable the movement of surface debris (e.g., soil and/or dirt) from the leading and trailing edges that are in contact with the surface (e.g., floor) to alternating positions that are within the overall perimeter of the mop frame. In accordance with certain embodiments of the invention, the recessed portions of the mop frame may taper inwardly in width as the recessed portion extend inwardly towards a central body portion of the mop frame.

In accordance with certain embodiments of the invention, the mop frame may further comprise a patterned geometry (e.g., a converging pattern) of angular fin projections located within the recessed portions of the mop frame. The patterned geometry of angular fin projections located within the recessed portions, according to certain embodiments of the invention, provide a plurality of angular wall-like segments on the bottom surface of the mop frame, which when a wiper material is attached to or overlying the bottom surface of the mop frame, facilitate an even distribution of surface debris (e.g., soil and/or dirt) across the wiper surface. In this regard, the plurality of angular fin projections may further direct or guide the surface debris (e.g., soil and/or dirt) into or towards a central or interior portion of the wiper material. In accordance with certain embodiments of the invention, the plurality of angular fin projections comprise a flexible material (e.g., a flexible polymeric material) and may flex or bend towards the central body portion of the mop frame when wiped our scrubbed across a surface (e.g., a floor) to be cleaned. In this regard, a flexible configuration of the plurality of angular fin projections may further facilitate directing or guiding the surface debris (e.g., soil and/or dirt) into or towards a central or interior portion of the wiper material in contact with the surface being cleaned. For example, flexible angular fin projections may gather debris (e.g., soil and/or dirt) initially in order to increase the efficient use of a majority of the wiper material, but when a sufficient amount of debris (e.g., soil and/or dirt) builds up on any single angular fin projection, it flexes and allows the debris to move farther inboard from the mop frame perimeter, thereby allowing the debris to be engaged and/or captured by a more interior or central portion of the wiper material.

In accordance with certain embodiments of the invention, a combination of the recessed portions and the plurality of angular fins may provide a notable increase in cleaning efficiency by more evenly distributing the surface debris (e.g., soil and/or dirt) across a greater percentage of the wiper material in contact with the surface being cleaned.

Mop frames in accordance with certain embodiments of the invention may comprise at least one retaining structure configured to releasably attach a cleaning fabric (e.g., a wiper material) proximate to or adjacent to at least the bottom surface of the mop frame. In certain embodiments of the invention, for example, the retaining structure may comprise a long narrow channels that runs substantially the entire length of front edge and the rear edge of the mop frame. In certain embodiments of the invention, each of the channels including an inside cross-section that comprises a narrow trough with an undercut pointed protrusion that additionally runs substantially the entire length of each channel. In this regard, the channels may each accept a separate portion of a wiper material and the corresponding undercut pointed protrusion locks the wiper material portions in place. For example, the undercut pointed protrusion may comprise a flexible polymeric material that allows insertion of the wiper material into the channel by flexing inwards towards the trough portion of the channel followed by recoiling back towards an initial positioning to squeeze or pinch the wiper material to retain the wiper material in an attached state until a user physically withdraws the wiper material from the channels. In this regard, a wiper material may easily be attached by inserting portions of the wiper material into the channels by a user's fingers. Moreover, a user may easily clean the channels by inserting an instrument with a cleaning cloth by pressing the cloth into the channel at one end and pushing it down the channel's length. Moreover, water and/or cleaner may be applied into the channel, which would flow down through the channel and out one end of the channel. Despite the channel-type attachment structure according to certain embodiments of the invention may enable an effective and quick way to clean the channels, the channels may in certain embodiments not get dirty because the wiper material may be pressed in along the entire length of each channel to keep debris (e.g., soil and/or dirt) from collecting at the bottom of the channels.

I. Definitions

The terms "substantial" or "substantially" may encompass the whole amount as specified, according to certain embodiments of the invention, or largely but not the whole amount specified according to other embodiments of the invention.

The terms "polymer" or "polymeric", as used interchangeably herein, may comprise homopolymers, copolymers, such as, for example, block, graft, random, and alternating copolymers, terpolymers, etc., and blends and modifications thereof. Furthermore, unless otherwise specifically limited, the term "polymer" or "polymeric" shall include all possible structural isomers; stereoisomers including, without limitation, geometric isomers, optical isomers or enantionmers; and/or any chiral molecular configuration of such polymer or polymeric material. These configurations include, but are not limited to, isotactic, syndiotactic, and atactic configurations of such polymer or polymeric material.

The term "layer", as used herein, may comprise a generally recognizable combination of similar material types and/or functions existing in the X-Y plane.

The terms "nonwoven" and "nonwoven web", as used herein, may comprise a web having a structure of individual fibers, filaments, and/or threads that are interlaid but not in an identifiable repeating manner as in a knitted or woven fabric. Nonwoven fabrics or webs, according to certain embodiments of the invention, may be formed by any process conventionally known in the art such as, for example, meltblowing processes, spunbonding processes, hydroentangling, air-laid, and bonded carded web processes.

The term "spunbond", as used herein, may comprise fibers which are formed by extruding molten thermoplastic material as filaments from a plurality of fine, usually circular, capillaries of a spinneret with the diameter of the extruded filaments then being rapidly reduced. According to an embodiment of the invention, spunbond fibers are generally not tacky when they are deposited onto a collecting surface and may be generally continuous. It is noted that the spunbond used in certain composites of the invention may include nonwoven described in the literature as SPINLACE®.

The term "meltblown", as used herein, may comprise fibers formed by extruding a molten thermoplastic material through a plurality of fine die capillaries as molten threads or filaments into converging high velocity, usually hot, gas (e.g. air) streams which attenuate the filaments of molten thermoplastic material to reduce their diameter, which may be to microfiber diameter, according to certain embodiments of the invention. According to an embodiment of the invention, the die capillaries may be circular. Thereafter, the meltblown fibers are carried by the high velocity gas stream and are deposited on a collecting surface to form a web of randomly disbursed meltblown fibers. Meltblown fibers are microfibers which may be continuous or discontinuous and are generally tacky when deposited onto a collecting surface.

The term "biocomposite", as used herein, may comprise two or more distinct substances having natural and biological origin that are combined to produce a new material with properties not present in either individual material. According to certain embodiments of the invention, biocomposite materials may comprise biopolymers and/or biofibers.

The term "biodegradable", as used herein, may comprise all biocomposite and biopolymeric materials including those composed at least in part of sustainable sources and whose cycle is $CO_2$ neutral, completely slag-free, and are biodegradable at the end of their useful lifetime (e.g., via natural biodecomposition or combustion).

II. Mop Frame and Cleaning Implement

In one aspect, the invention is directed to a mop frame (e.g., a flat mop frame) structurally configured to improve and/or facilitate a more even distribution of floor debris (e.g., dirt and/or soil) across a surface of a wiper attached to the mop frame. In certain embodiments of the invention, the mop frame comprise one or more frontal recessed portions defined, at least in part, by a bottom surface and front edge of the mop frame. In accordance with certain embodiments of the invention, the mop frame may also include one or more rearward recessed portions defined, at least in part, by the bottom surface and rear edge of the mop frame. Mop frames according to certain embodiments of the invention, for example, may comprise a central body portion, a top surface, a bottom surface, diametrically opposed side edges, and diametrically opposed front and rear edges. Such mop frames according to certain embodiments of the invention may also comprise at least one frontal recessed portion extending from the front edge towards the central body portion, wherein the at least one frontal recessed portion defines a front open area along the length of the front edge of the mop frame. In accordance with certain embodiments of the invention, the mop frame may further comprise at least one rearward recessed portion extending from the rear edge towards the central body portion, wherein the at least one rearward recessed portion defines a rear open area along the length of the rear edge. In this regard, mop frames according to certain embodiments of the invention may comprise at least one frontal recessed portion including at least a first frontal recessed portion and the at least one rearward recessed portions including a first rearward recessed portion. Mop frames according to certain embodiments of the invention may also comprise a plurality of angular fin projections located within the first frontal recessed portion and/or the first rearward recessed portion. In certain embodiments according to the invention, each of the frontal recessed portions and each of the rearward recessed portions may include a plurality of angular fin projections located therein. The plurality of angular fin projections, according to certain embodiments of the invention, may comprise a patterned geometry (e.g., a converging pattern) of the plurality of angular fin projections located within the recessed portions of the mop frame. In this regard, the plurality of angular fin projections may be configured to further direct or guide surface debris (e.g., soil and/or dirt) into or towards a central or interior portion of a wiper material attached to the mop frame. Mop frames in accordance with certain embodiments of the invention may comprise at least one retaining structure configured to releasably attach a cleaning fabric (e.g., a wiper material) proximate to or adjacent to at least the bottom surface of the mop frame (e.g., the surface contacting a floor for cleaning).

In accordance with certain embodiments of the invention, the one or more frontal recessed portions may be defined at least in part by the bottom surface and front edge of the mop frame. In this regard, the frontal recessed portions may each independently be defined by corresponding deep-set (or recessed) portions formed in the front edge and bottom surface to form hollow or tunnel-like portions in the mop frame. For instance, the frontal recessed portions may also, according to certain embodiments of the invention, be described as "cut-out" portions of the frame in which material has been removed from the mop frame to provide hollow or tunnel-like portions or structures in the mop frame. In accordance with certain embodiments of the invention, for example, the frontal recessed portions may comprise a top wall and at least one side wall.

Similarly, the one or more rearward recessed portions, according to certain embodiments of the invention, may be defined at least in part by the bottom surface and rear edge of the mop frame. In this regard, the rearward recessed portions may each independently be defined by corresponding deep-set (or recessed) portions formed in the rear edge and bottom surface to form hollow or tunnel-like portions in the mop frame. For instance, the rearward recessed portions may also, according to certain embodiments of the invention, be described as "cut-out" portions of the frame in which material has been removed from the mop frame to provide hollow or tunnel-like portions or structures in the mop frame. In accordance with certain embodiments of the invention, for example, the rearward recessed portions may comprise a top wall and at least one side wall.

The frontal and/or rearward recessed portions, in accordance with certain embodiments of the invention, may each comprise a top wall and at least one side wall. In this regard, the top wall and the at least one side wall may further define the overall geometry of each recessed portion of the mop frame. Recessed portions (e.g., frontal and/or rearward recessed portions) may comprise either a continuous or variable cross-section taken across a longitudinal axis and/or a transverse axis of the mop frame, in which a longitudinal direction of the mop frame may be defined as the direction from the opposing side edges and may be longer than the transverse direction defined by the direction from opposing front and rear edges. In accordance with certain embodiments of the invention, each of the recessed portions (e.g., frontal and/or rearward recessed portions) may independently have the same or different overall geometric configuration, in which the corresponding longitudinal and/or transverse cross-sections may be tailored to promote a more even distribution of surface debris (e.g., soil and/or dirt) by, for example, reducing the build-up of surface debris (e.g., soil and/or dirt) along the leading edge(s) of the mop frame and enabling more surface debris (e.g., soil and/or dirt) to be contacted and/or engaged by a larger area the of the wiper material (e.g., the central portion of the wiper material). For example, at least one of the recessed portions (e.g., frontal and/or rearward recessed portions) may comprise a substantially planar or flat top wall, which may or may not be substantially parallel with the bottom surface of the mop frame. In certain embodiments of the invention, the top wall of the recessed portions (e.g., frontal and/or rearward recessed portions) may not be flat or planar in nature, but have a concave (or at least a portion thereof) or convex (or at least a portion thereof) structure. In this regard, the top wall of the recessed portions (e.g., frontal and/or rearward recessed portions), according to certain embodiments of the invention, may include flat or planar portions, concave portions, convex portions, or any combination thereof. In this regard, the depth or height (e.g., the dimensional length from a plane including the bottom surface of the mop frame to the top wall) of the recessed portions (e.g., frontal and/or rearward recessed portions) may vary.

In accordance with certain embodiments of the invention, the at least one side wall of each of the recessed portions (e.g., frontal and/or rearward recessed portions) may comprise from 1 to about 50 side walls. In other embodiments of the invention, for example, the at least one side wall of each of the recessed portions (e.g., frontal and/or rearward recessed portions) may comprise from about 1 to about 10 side walls. In further embodiments of the invention, for instance, the at least one side wall of each of the recessed portions (e.g., frontal and/or rearward recessed portions) may comprise from about 1 to about 3 side walls. As such, in certain embodiments of the invention, the at least one side wall of each of the recessed portions (e.g., frontal and/or rearward recessed portions) may comprise a number of side walls from at least about any of the following: 1, 2, and 3 side walls and/or at most about 50, 30, 20, 10, 5, and 3 side walls (e.g., 1-3 side walls, 2-5 side walls, etc.). In accordance with certain embodiments of the invention, for example, the one or more of the recessed portions (e.g., frontal and/or rearward recessed portions) may comprise a single curvilinear wall (e.g., an arcuate shape), two side walls that meet at a junction point distally located from an outer perimeter of the mop frame (e.g., a generally V-shape), or three side walls forming a generally U-shape. As noted above the depth or height of the recessed portions (e.g., frontal and/or rearward recessed portions) may vary based on the depth or height (e.g., the dimensional length from a plane including the bottom surface of the mop frame to the top wall) of the at least one side wall. In this regard, the side wall(s) may each independently have the same or different depth or height and each of the side wall(s) further defining a particular recessed portion may vary along a length of each side wall.

In accordance with certain embodiments of the invention, the mop frame may comprise, for example, at least a first frontal recessed portion cross-section proximate to and parallel with the front edge of the mop (e.g., a longitudinal axis of the mop frame) and a second frontal recessed portion cross-section distal from and parallel with the front edge of the mop (e.g., a longitudinal axis of the mop frame), in which the first frontal recessed portion cross-section may comprise a value larger than the second frontal recessed portion cross-section. In this regard, the cross-section of a particular recessed portion (or all) taken along a longitudinal axis of the mop frame may, in accordance with certain embodiments of the invention, may generally narrow in cross-sectional area towards the central body portion of the mop frame as compared to the cross-sectional area proximate or at the perimeter (e.g., the front edge or rear edge) of the mop frame.

Certain embodiments in accordance with the invention may comprise, for example, at least a first frontal recessed portion and at least a first rearward recessed portion. In one such embodiment, the first frontal recessed portion and the first rearward recessed portion may each comprises a variable cross-section taken across a longitudinal axis and/or a transverse axis of the mop frame, in which a longitudinal direction of the mop frame may be defined as the direction from the opposing side edges and may be longer than the transverse direction defined by the direction from opposing front and rear edges. In this regard, the general shape of the cross-section taken across a longitudinal axis and/or a transverse axis may vary. Any variance in the cross-section of the recessed portions (e.g., frontal and/or rearward recessed portions) may comprise an overall structure that facilitate a more even distribution of surface debris (e.g., soil and/or dirt) across a wiper material attached to the mop frame when being used to wipe and/or clean a surface, such as a floor.

Certain embodiments according to the invention, for example, the height or depth of a particular recessed portion at the perimeter of the mop frame may comprise a value less than the total height of the mop frame at the corresponding portion of the perimeter of the mop frame. For example, the front edge may comprise a front edge height defined by a front length extending from the bottom surface of the mop frame to the top surface of the mop frame and the at least one side wall of the first frontal recessed portion defines a first frontal recessed portion depth, in which the first frontal recessed portion depth is less than the front edge height. In accordance with certain embodiments of the invention, the mop frame may also include a first rearward recessed portion and the rear edge of the mop frame comprises a rear edge height defined by a rear length extending from the bottom surface of the mop frame to the top surface of the mop frame. In such embodiments of the invention, for example, the at least one side wall of the first rearward-recessed portion defines a first rearward recessed portion depth that is less than the rear edge height. The first frontal recessed portion depth, according to certain embodiments, comprises a variable depth including an outer depth proximate to the front edge and an inner depth distal from the front edge (e.g., towards the central body portion of the mop frame), in which the outer depth may be larger than the inner depth. Mop frames according to certain embodiments of the invention may further comprise a variable first rearward recessed portion depth including an outer depth proximate to the rear edge and an inner depth distal from the rear edge, in which the outer depth may be larger than the inner depth.

In accordance with certain embodiments of the invention, the recessed portions (e.g., frontal and/or rearward recessed portions) of the mop frame may comprise a top wall that is (completely or in-part) substantially parallel to the bottom surface of the mop frame. In certain embodiments of the invention, at least one of the at least one side walls (completely or in-part) may be substantially perpendicular to the bottom surface of the mop frame.

Mop frames according to certain embodiments of the invention, may comprise from 1 to about 20 frontal recessed portions and/or from 1 to about 20 rearward recessed portions. In other embodiments of the invention, for example, the mop frame may comprise from 2 to about 15 frontal recessed portions and/or from 2 to about 15 rearward recessed portions. In certain embodiments of the invention, the mop frame may comprise from 4 to about 10 frontal recessed portions and/or from 4 to about 10 rearward recessed portions. As such, in certain embodiments of the invention, the mop frame may comprise from at least about any of the following: 1, 2, 3, 4, and 5 frontal recessed portions and/or at most about 30, 20, 15, 10, and 8 frontal recessed portions (e.g., 1-10 frontal recessed portions, 2-8 frontal recessed portions, etc.). Mop frames according to certain embodiments of the invention may further comprise from at least about any of the following: 1, 2, 3, 4, and 5 rearward recessed portions and/or at most about 30, 20, 15, 10, and 8 rearward recessed portions (e.g., 1-10 rearward recessed portions, 2-8 rearward recessed portions, etc.).

As noted above, the frontal recessed portion(s) define a front open area along the length of the front edge of the mop frame and the rearward recessed portion(s) define a rear open area along the length of the rear edge of the mop frame. In accordance with certain embodiments, the front open area may comprise from about 10% to about 95% of the total length of the front edge and/or the rear open area may comprise from about 10% to about 95% of the total length of the rear edge. The front open area, for example, may comprise from at least about any of the following: 10%, 20%, 30%, 40%, and 50% of the total length of the front edge of the mop frame and/or at most about 95%, 90%, 85%, 80%, 75%, 70%, 65%, and 60% of the total length of the front edge of the mop frame. Mop frames according to certain embodiments may further comprise a rear open area comprising from at least about any of the following: 10%, 20%, 30%, 40%, and 50% of the total length of the rear edge of the mop frame and/or at most about 95%, 90%, 85%, 80%, 75%, 70%, 65%, and 60% of the total length of the rear edge of the mop frame.

Certain embodiments of the invention may comprise a plurality of angular fin projections located within at least the first frontal recessed portion and/or the first rearward recessed portion. In one such embodiment, each and every frontal recessed portion and rearward recessed portion comprises a plurality of angular fin projections located therein. As noted above, the angular fin projections may be configured in a patterned geometry and provide a plurality of angular wall-like segments on the bottom surface of the mop frame, which when a wiper material is attached to or overlying the bottom surface of the mop frame, facilitate an even distribution of surface debris (e.g., soil and/or dirt) across the wiper surface. In this regard, the plurality of angular fin projections may further direct or guide the surface debris (e.g., soil and/or dirt) into or towards a central or interior portion of the wiper material.

The plurality of angular fin projections located within a particular recessed portion (e.g., at least the first frontal recessed portion) may comprise a first pair of arrays configured in a converging pattern such that movement of surface debris may be facilitated towards the interior portion of a wiper material generally coinciding with the central body portion of the bottom surface of the mop frame. In certain embodiments of the invention, for example, the pair of arrays includes a first array of individual angular fin projections and a second array of individual angular fin projections, in which each of the individual angular fin projections may be oriented at an angle from between about 5 to about 85 degrees from a longitudinal axis (as discussed above) of the mop frame. In accordance with certain embodiments of the invention, the individual angular fin projections for at least the first array may be equidistantly spaced apart from each other. In accordance with certain embodiments of the invention, each recessed portion may comprise one or more arrays of individual angular fin projections in which the individual angular fin projections of each array may be equidistantly spaced apart from each other. In accordance with other embodiments of the invention, the individual angular fin projections for a given array may not be equidistantly spaced apart from each other. In this regard, the relative positioning of the individual angular fin projections within a given area of the recessed portion may be varied such that the spacing between adjacent angular fin projections varies from a direction from the perimeter of the mop frame towards the central body portion of the mop frame (e.g., transverse direction).

In accordance with certain embodiments of the invention, at least one (or each) of the plurality of angular fin projections located, for example, within at least a first frontal recessed portion and/or at least a first rearward recessed portion comprise a base end adjacent the corresponding top wall of the recessed portion and extends in a wall-like manner towards the bottom surface (e.g., mopping plane or plane in contact with a surface to be cleaned by the mop frame) and terminates at a tip end located at a bottom plane (e.g., mopping plane) including the bottom surface. In this regard, the tip ends of the plurality of angular fin projections may terminate in a mopping plane which includes the bottom surface of the mop frame. In certain embodiments of the invention, the tip ends of the plurality of angular fin projections may terminate on either side of the mopping plane which includes the bottom surface of the mop frame if desired.

In accordance with certain embodiments of the invention, the plurality of angular fin projections may comprise a flexible material (e.g., a flexible polymeric material) and may flex or bend towards the central body portion of the mop frame when wiped our scrubbed across a surface (e.g., a floor) to be cleaned. In this regard, a flexible configuration of the plurality of angular fin projections may further facilitate directing or guiding the surface debris (e.g., soil and/or dirt) into or towards a central or interior portion of the wiper material in contact with the surface being cleaned. For example, flexible angular fin projections may gather debris (e.g., dirt and/or soil) initially in order to increase the efficient use of a majority of the wiper material, but when a sufficient amount of debris (e.g., dirt and/or soil) builds up on any single angular fin projection, it flexes and allows the debris to move farther inboard from the mop frame perimeter, thereby allowing the debris to be engaged and/or captured by a more interior or central portion of the wiper material. In accordance with certain embodiments of the invention, the plurality of angular fin projections may flex inwards towards the central body portion of the mop frame under routine mopping, wiping, or scrubbing action when cleaning a surface, such as a floor.

Certain embodiments of the invention comprise angular fin projections including a first thickness at the base end and a second thickness at the tip end of the angular fin projection, in which the first thickness may be larger than the second thickness. In other embodiments of the invention, the first thickness may be the same as or smaller than the second thickness. In accordance with certain embodiments of the invention, for example, the percentage difference between the first thickness at the base end and the second thickness at the tip end may comprise at least any of the following: 1%, 5%, 10%, 20%, and 25% and/or at most about 75%, 60%, 50%, 40%, and 30%. (e.g., 1-20% difference, 10-40% difference, etc.). In accordance with certain embodiments of the invention, the differing thickness between the base end and the tip end of the plurality of angular fin projections may increase or decrease the flexibility of the angular fin projections.

In accordance with certain embodiment of the invention, the plurality of angular fin projections within a given recessed portion may comprise from about 1 to about 50 individual angular fin projections. In other embodiments of the invention, for example, the plurality of angular fin projections within a given recessed portion may comprise may comprise from 2 to about 40 individual angular fin projections. In certain embodiments of the invention, the plurality of angular fin projections within a given recessed portion may comprise from about 4 to about 20 individual angular fin projections. As such, in certain embodiments of the invention, the plurality of angular fin projections within a given recessed portion may comprise at least about any of the following: 1, 2, 3, 4, 6, 8, and 10 individual angular fin projections and/or at most about 60, 50, 40, 30, 20, 15, and 10 individual angular fin projections (e.g., 6-20 individual angular fin projections, 10-40 individual angular fin projections, etc.).

In accordance with certain embodiments of the invention, the mop frame may comprise a plurality of recessed portions (e.g., frontal and/or rearward) having a plurality of angular fin projections therein. The individual angular fin projections may be independently oriented at an angle from between about 5 to about 85 degrees from a longitudinal axis (as discussed above) of the mop frame. As such, in certain embodiments of the invention, the individual angular fin projections may be independently oriented at an angle of at least about any of the following: 5, 10, 15, 20, 25, 30, 35, and 40 degrees from a longitudinal axis (as discussed above) of the mop frame and/or at most about 85, 80, 70, 60, 50, and 45 degrees from a longitudinal axis (as discussed above) of the mop frame (e.g., 10-45, 30-60 degrees from a longitudinal axis of the mop frame, etc.).

Mop frames in accordance with certain embodiments of the invention may comprise at least one retaining structure configured to releasably attach a cleaning fabric (e.g., a wiper material) proximate to or adjacent to at least the bottom surface of the mop frame. In accordance with certain embodiments of the invention, the at least one retaining structure comprises a first channel being open in an upwardly facing direction (e.g., away from the bottom surface of the mop frame) and comprising an open section located at or proximate the top surface. In such embodiments, the first channel may be configured for receiving a portion of a cleaning fabric (e.g., a wiper material) and comprising at least a first flexible pointed protrusion configured to engage and releasably secure the portion of the cleaning fabric within the first channel. In one embodiment, the first flexible pointed protrusion may be located at or proximate the open section of the first channel. In accordance with certain embodiments, the first channel may be located at or proximate to the front edge of the mop frame. In certain embodiments of the invention, the first channel may extend or run along about 50% to about 100% (e.g., about 60% to about 95%, about 75% to about 90%, etc.) of a longitudinal length of the mop frame, such as the font edge of the mop frame.

In accordance with certain embodiments of the invention, the at least one retaining structure may further comprises a second channel being open in an upwardly facing direction and comprising a second open section located at or proximate the top surface. In one such embodiment, the second channel may be configured for receiving a second portion of the cleaning fabric and comprising a second flexible pointed protrusion configured to engage and releasably secure the second portion of the cleaning fabric within the second channel. In certain embodiments of the invention, the second flexible pointed protrusion may be located at or proximate the second open section of the second channel. In accordance with certain embodiments, the second channel may be located at or proximate to the rear edge of the mop frame. In certain embodiments of the invention, the second channel may extend or run along about 50% to about 100% (e.g., about 60% to about 95%, about 75% to about 90%, etc.) of a longitudinal length of the mop frame, such as the rear edge of the mop frame.

In certain embodiments of the invention, for example, the retaining structure may comprise two long narrow channels (each open in an upward direction and away from the bottom surface of the mop frame) that runs substantially the entire length of the front edge and the rear edge of the mop frame. In certain embodiments of the invention, each of the channels may comprise an inside cross-section that comprises a narrow trough with an undercut pointed protrusion that additionally runs substantially the entire length of each channel. In this regard, the channels may each accept a separate portion of a wiper material and the corresponding undercut pointed protrusion locks the wiper material portions in place. For example, the undercut pointed protrusion may comprise a flexible polymeric material that allows insertion of the wiper material into the channel by flexing inwards towards the trough portion of the channel followed by recoiling back towards an initial positioning to squeeze or pinch the wiper material to retain the wiper material in an attached state until a user physically withdraws the wiper material from the channels. In this regard, a wiper material may easily be attached by inserting portions of the wiper material into the channels by a user's fingers.

In accordance with certain embodiments of the invention, the first channel may be configured in a manner in which the first channel is open in a frontward facing direction (e.g., open towards the front edge and away from the rear edge of the mop frame) and comprising an open section located at the front edge. In such embodiments of the invention, the first channel may be configured for receiving a portion of a cleaning fabric (e.g., wiper material) and comprising at least a first flexible pointed protrusion configured to engage and releasably secure the portion of the cleaning fabric within the first channel. In one such embodiment of the invention, the first flexible pointed protrusion may be located at or proximate the open section of the first channel. In certain embodiments of the invention, the first channel may extend or run along about 50% to about 100% (e.g., about 60% to about 95%, about 75% to about 90%, etc.) of a longitudinal length of the mop frame, such as the font edge of the mop frame. In certain embodiments of the invention, the second channel may be configured in a manner in which the second channel is open in a rearward facing direction (e.g., open towards the rear edge and away from the front edge of the mop frame) and comprising an open section located at the rear edge of the mop frame. In one such embodiment of the invention, the retaining structure may comprise two long narrow channels that runs substantially the entire length of the front edge and the rear edge of the mop frame, in which the first channel is open towards the frontward direction (away from the rear edge of the mop frame) and the second channel is open towards the rearward direction (away from the front edge of the mop frame).

The at least one retaining structure, in accordance with certain embodiments of the invention, may comprise a generally S-shaped channel structure comprising a first open section located at or proximate the top surface of the mop frame and facing in an upwardly direction (away from the bottom surface of the mop frame) and a second open section located at or proximate the bottom surface and facing in an downwardly direction (away from the top surface of the mop frame). The generally S-shaped channel structure may be configured to releasably secure a first portion of a cleaning fabric (e.g., wiper material) within the first open section and releasably secure a second portion of a cleaning fabric within the second open section.

As noted above, the at least one retaining structure may engage and releasably attach a wiper material to the mop frame. The selection of a wiper material is not particularly limited and may comprise a woven or nonwoven fabric. In accordance with certain embodiments of the invention, the wiper material may comprise at least one of a meltblown layer or a spunbond layer. In accordance with certain embodiments of the invention, the wiper material may comprise one or more nonwoven layers, such as at least meltblown layer and/or at least one spunbond layer.

FIG. 1 is an isometric view of a cleaning implement 1 including a handle portion 5, a yoke assembly 10, and a mop frame 20, in which the yoke assembly 10 attaches the handle portion 5 to the mop frame 20. As illustrated in FIG. 1, the mop frame 20 includes a central body portion 22, a top surface 24, a bottom surface 26, diametrically opposed side edges 27*a*, 27*b*, and diametrically opposed front edge 28 and rear edge 29. The mop frame 20 illustrated in FIG. 1 includes a wiper material 60 attached thereto, in which the wiper material 60 is releasably attached to the mop frame 20 via retaining structures comprising channels 50*a*, 50*b* located proximate the front edge 28 and the rear edge 29. As illustrated in FIG. 1, each of the retaining channels comprise channels 50*a*, 50*b*, which are open in an upwardly direction (away from the bottom surface 26). Illustrated by dashed lines in FIG. 1 are frontal recessed portions 30. The frontal recessed portions 30 are illustrated by dashed lines since the wiper material 60 actually overlies or covers the frontal recessed portions 30 of the mop frame 20. FIG. 1 also shows an optional end cap portion 21.

Figure 2A:
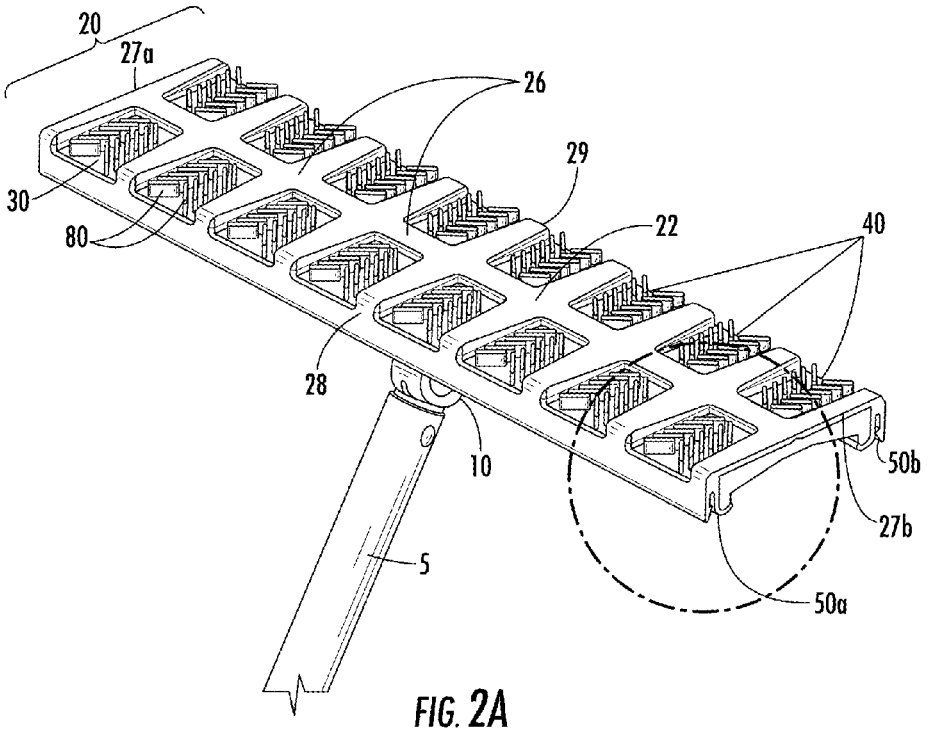
FIG. 2A is an isometric view of the underside of the flat mop frame shown in FIG. 1 in which the wiper material has been removed to illustrate the structural configuration of the flat mop frame according to an embodiment of the invention.

FIG. 2A is an isometric view of the underside of the flat mop frame 20 illustrated in FIG. 1 with the wiper material 60 removed to better illustrate the structural configuration of the flat mop frame 20 according to an embodiment of the invention. As shown in FIG. 2A, the mop frame 20 includes a plurality of frontal recessed portions 30 defined at least in part by the front edge 28 and bottom surface 26 of the mop frame 20, a plurality or rearward recessed portions 40 defined at least in part by the rear edge 29 and bottom surface 26 of the mop frame 20, including a plurality of angular fin projections 80 located within each recessed portion 30, 40 of the mop frame 20. The particular embodiment illustrated by FIG. 1 and FIG. 2A includes eight frontal recessed portions 30 and eight rearward recessed portions 40 providing a relatively large frontal and rearward open area along the front edge 28 and rear edge 29. In this regard, a leading edge defined by a junction between the front edge 28 and bottom surface 26 is mostly open or part of the frontal recessed portions 30 to facilitate more even distribution of surface debris as discussed above. Similarly, a trailing edge defined by a junction between the rear edge 29 and bottom surface 26 is mostly open or part of the rearward recessed portions 40 to facilitate more even distribution of surface debris as discussed above. FIG. 2A also illustrates retaining structures each comprising a channel 50*a*, 50*b* and an opening facing away from the bottom surface 26.

Figure 2B:
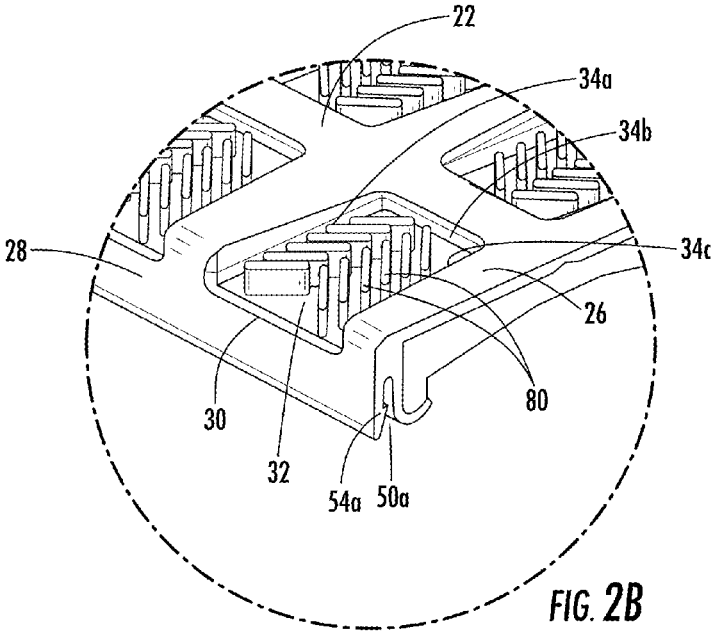
FIG. 2B is an exploded view of a corner of the flat mop frame shown in FIG. 2A according to an embodiment of the invention.
Figure 2C:
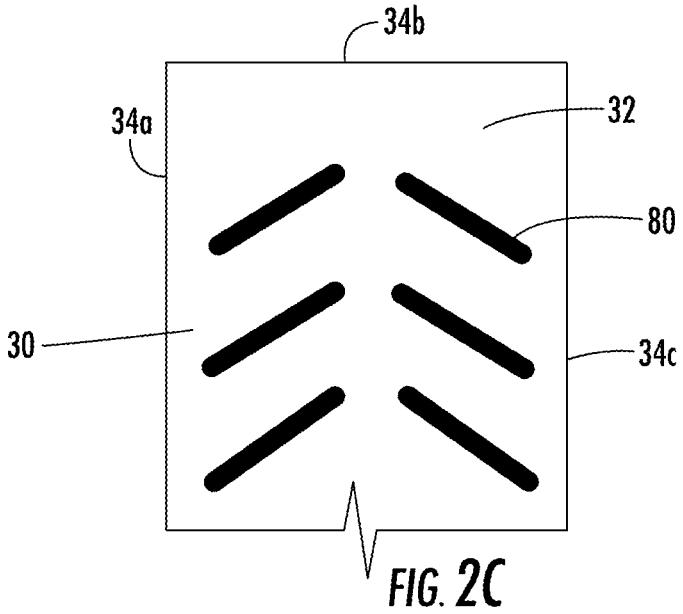
FIG. 2C illustrates a plurality of angular fin projections configured in a converging pattern according to an embodiment of the invention.
Figure 2D:
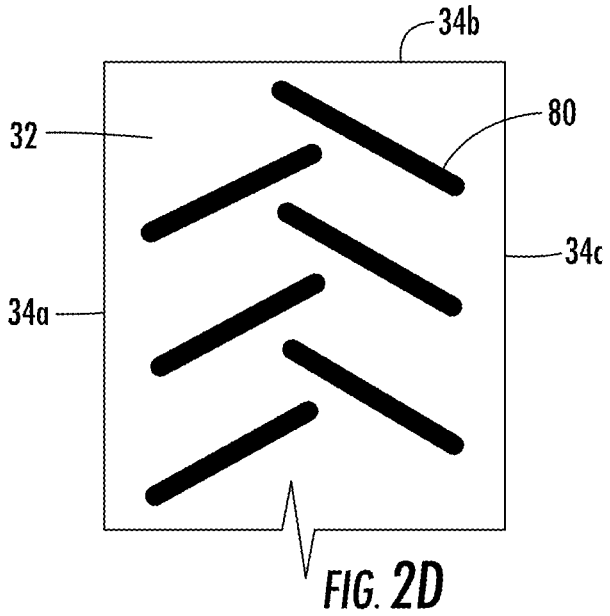
FIG. 2D illustrates a plurality of angular fin projections configured in an alternative converging pattern according to an embodiment of the invention.

FIG. 2B is an exploded view of a corner of the flat mop frame 20 shown in FIG. 2A according to an embodiment of the invention. FIG. 2B illustrates the location of a plurality of angular fin projections 80 located within a frontal recessed portion 30. The plurality of angular fin projections 80 are oriented in a converging pattern to facilitate movement or channeling of surface debris inwardly towards the central body portion 22 of the mop frame 20. In this particular embodiment of the invention, each of the angular fin projections 80 are oriented at an angle of approximately between 40-60 degrees from a longitudinal axis of the mop frame 20, such as the front edge 28 of the mop frame 20. FIG. 2A also illustrates and embodiment in which the frontal recessed portion 30 includes a top wall 32 and three side walls 34*a*, 34*b*, 34*c*, which further define the frontal recessed portion 30. FIGS. 1-2B also illustrate embodiments of the invention including wiper retaining structures comprising channels 50*a*, 50*b*. FIG. 2B further illustrates wiper retaining structure comprising channel 50*a* including a flexible projection 54*a* for engaging a portion of the wiper material 60. FIG. 2C illustrates a top view of the plurality of angular fin projections 80 having a converging pattern within a frontal recessed portion 30 according to one embodiment of the invention. FIG. 2D illustrates a top view of a plurality of angular fin projections 80 having a different converging pattern within frontal recessed portion 30, in which the individual angular fin projections of a first array of angular fin projections partially overlap with individual angular fin projections of a second array of angular fin projections. Although FIGS. 2C and 2D illustrate side wall 34*a* and 34*c* as being parallel to each other, these side walls 34*a*, 34*b* need not be parallel to each other.

Figure 3A:
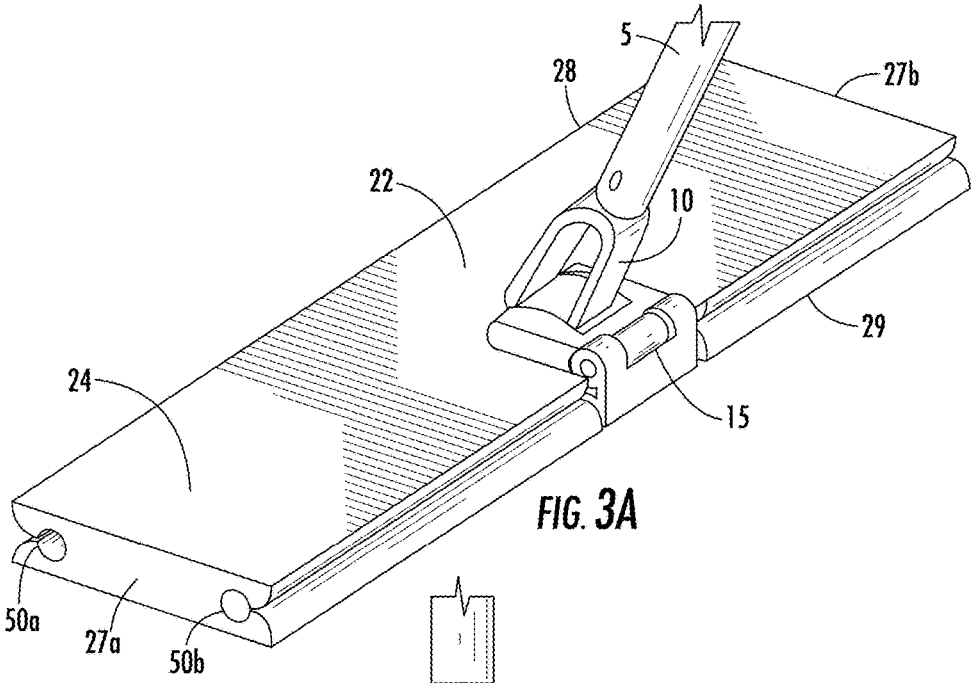
FIGS. 3A-3C illustrate a flat mop frame including wiper retaining structures on the front edge and rear edge of the flat mop frame in conjunction with a yoke assembly according to an embodiment of the invention.
Figure 3B:
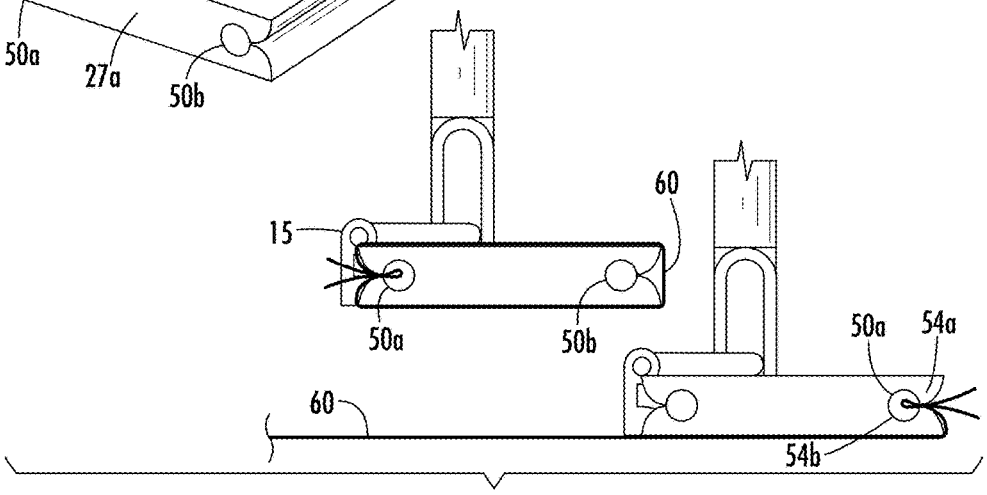
Figure 3C:
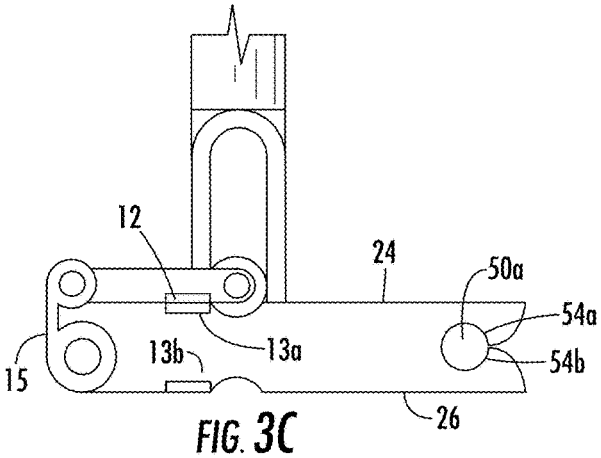
Figure 4A:
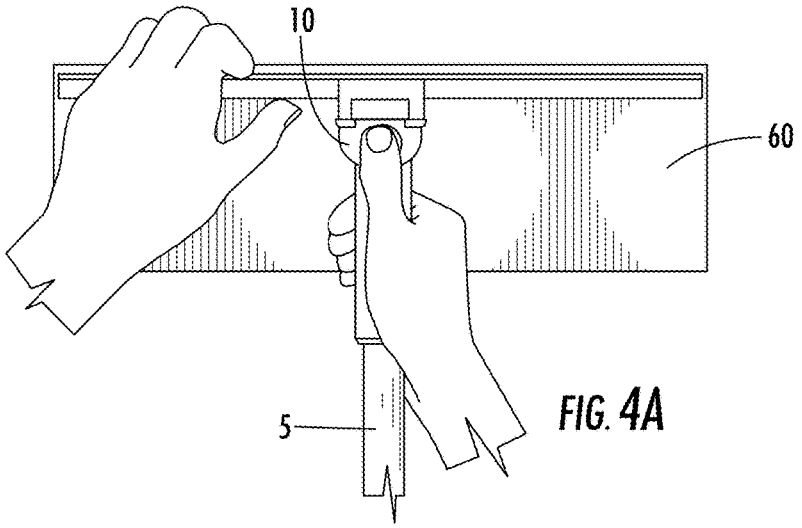
FIGS. 4A-4D illustrate a flat mop frame including a S-shaped wiper retaining structure in conjunction with a yoke assembly according to an embodiment of the invention.
Figure 4B:
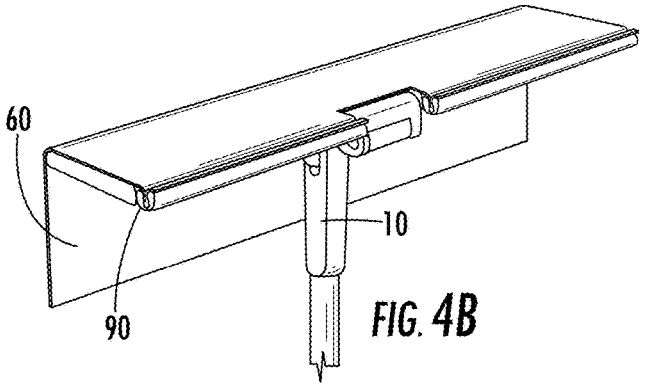
Figure 4C:
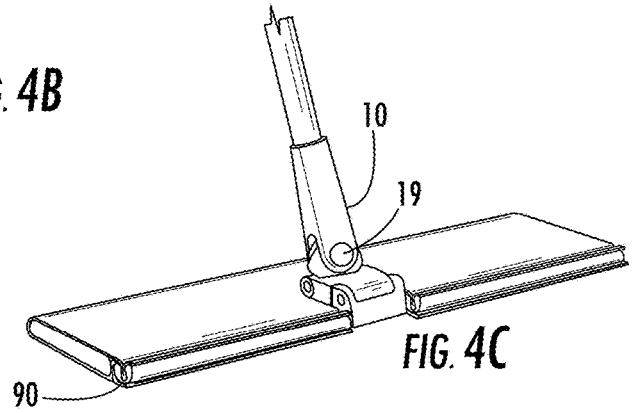
Figure 4D:
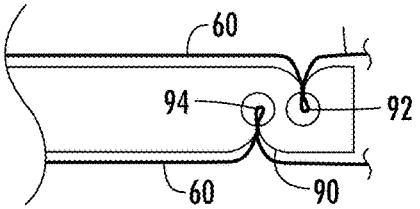

FIGS. 3A-3C illustrate a flat mop frame 20 including wiper retaining structures comprising channels 50*a*, 50*b* on the front edge 28 and rear edge 29 of the flat mop frame 20 in conjunction with a yoke assembly 10 having a handle 5 attached thereto according to an embodiment of the invention. In such an embodiment of the invention, a wiper material 60 may be attached to the mop frame such that the wiper material covers essentially only the bottom surface 26 or alternatively the wiper material 60 may be wrapped around the entirety of the mop frame 20. FIG. 3C provides a good illustration of retaining structure comprising a channel 50*a* including flexible projections 54*a*, 54*b* for engaging a portion of the wiper material 60. FIG. 3C also illustrates a point-like hinge yoke assembly 10 which may pivot to either side (e.g., top surface 24 and bottom surface 26) of the mop frame 20. This particular yoke assembly 10 may comprise a hinge portion 15 which enables the yoke assembly 10 to swivel or swing from one surface (e.g., top surface 24) of the mop frame 20 to an opposite surface (e.g., bottom surface 26) of the mop frame 20. The yoke assembly 10 may also include a male-shaped engagement portion 12 configured to insert and releasably couple with female-shaped engagement portions 13 or vice versa. The male-shaped engagement portion 12 and the female-shaped engagement portions 13 are not particularly limited in structure as long as they collectively provide a mechanism for releasable engaging and holding the yoke assembly 10 to a given side of the mop frame 20 in which the hinge portion 15 remains motionless while the male-shaped engagement portion 12 and one of the female-shaped engagement portions 13 are releasably engaged or coupled. Additionally or alternatively, the engagement portions 12,13 may comprise or consist of magnets to facilitate and/or provide a mechanism for releasably engagement or coupling.

FIGS. 4A-4D illustrate a flat mop frame 20 including wiper retaining structure comprising a S-shaped wiper retaining structure 90 comprising a first open section (e.g., channel) 92 located at or proximate the top surface 24 of the mop frame 20 and facing in an upwardly direction (away from the bottom surface 26 of the mop frame 20) and a second open section (e.g., channel) 94 located at or proximate the bottom surface 26 and facing in an downwardly direction (away from the top surface 24 of the mop frame 20). The generally S-shaped wiper retaining structure 90 may be configured to releasably secure a first portion of a cleaning fabric (e.g., wiper material 60) within the first open section 92 and releasably secure a second portion of a cleaning fabric within the second open section 94. FIGS. 4A-4D also illustrate the yoke assembly 10 comprising a hinge portion 15 which enables the yoke assembly 10 to swivel or swing from one surface (e.g., top surface 24) of the mop frame 20 to an opposite surface (e.g., bottom surface 26) of the mop frame 20. The yoke assembly 10 also comprises a locking element 19 which may trigger a locking feature to lock and/or unlock the mop frame 20 relative to the yoke assemble 10. Although FIGS. 4A-4D illustrate an embodiment with both the locking element 19 and the S-shaped wiper retaining structure 90, certain embodiments in accordance with the invention may include only one of the locking element 19 and the S-shaped wiper retaining structure 90. For instance, the locking element 19 may be present without the presence of the S-shaped wiper retaining structure and vice versa. In this regard, the user may insert a portion of the wiper material 60 into first open section 92 by application of pressure with the user's fingers. The user can then wrap the wiper material 60 around the mop frame 20 and insert the free end of the wiper material 60 into the second open section (e.g., channel) 94.

Figure 5:
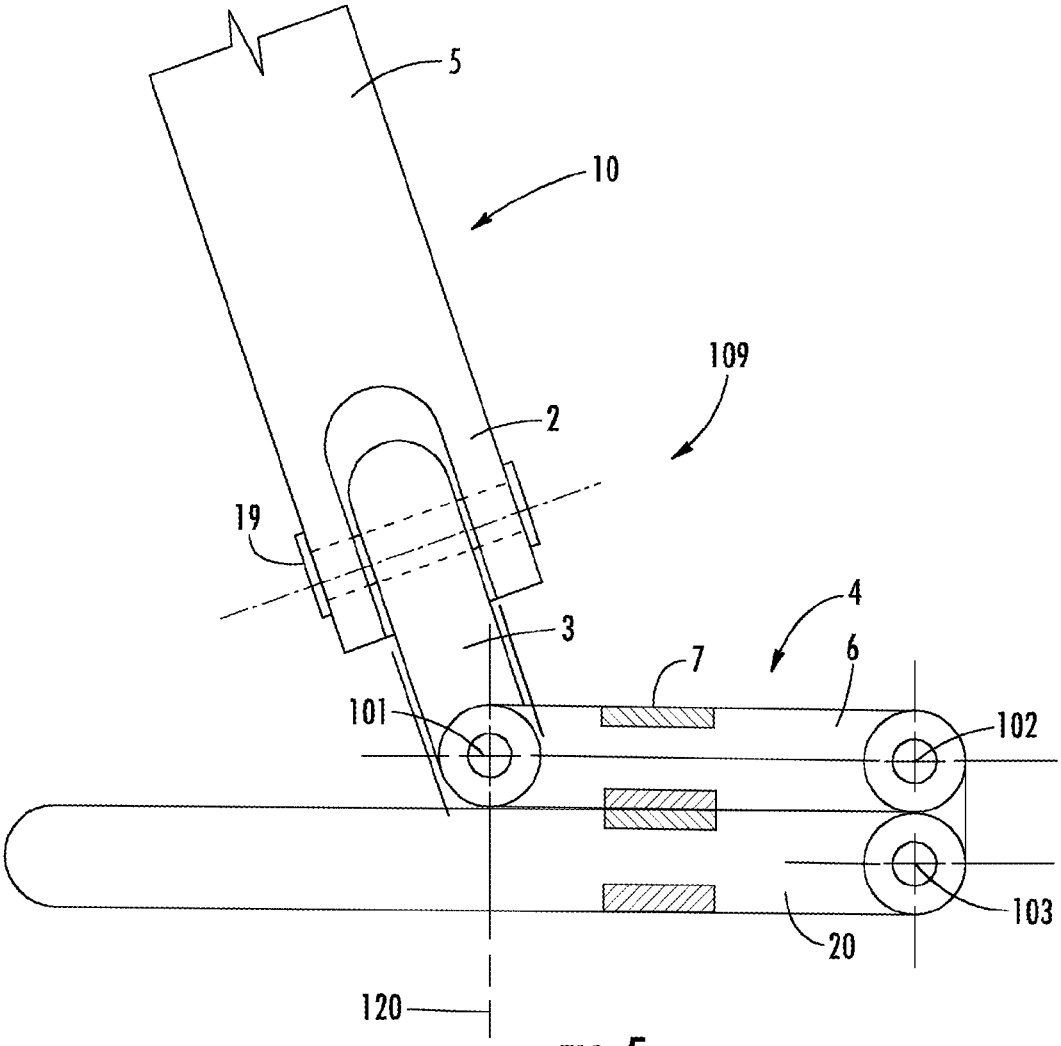
FIG. 5 illustrates a multi-pivoting hinge attached to a mop frame in accordance with certain embodiments of the invention.

FIG. 5 illustrates an embodiment comprising a multi-pivoting hinge 4 attached to a mop frame 20 in accordance with certain embodiments of the invention. In the particular embodiment illustrated in FIG. 5, a yoke assembly 10 comprises a yoke clamp 2 and a yoke joint 3, which is attached to a multi-pivoting hinge 4 comprised of three (3) rotational axes 101,102,103 that allows the yoke assembly 10 with attached handle 5 to rotate to either side of the mop frame 20. Additionally, this multi-pivoting hinge 4 comprises an assembly of two (2) joints that allow an upper joint 6 to lay flat against either side of the flat mop frame. In accordance with certain embodiments of the invention, the upper joint 6 comprises a length that allows the handle to be centrally located over the mop frame, in turn, providing a centrally located downward force when a pressure is applied with a push motion, in turn, providing an even distribution of force over the mop frame. In this regard, the handle may be centrally located along the length of the mop frame (e.g., centrally located between side edges 27*a*,27*b*), centrally located along the width of the mop frame (e.g., centrally located between front edge 28 and rear edge 29), or both. In accordance with certain embodiments of the invention, for example, the handle may be centrally located with respect to both the length and width of the mop frame. As illustrated in FIG. 5, for example, the centerline 120 for the mop frame 20 and an end of the yoke joint 3 proximate to the mop frame may coincide at the same location.

As illustrated in FIG. 5, the upper joint 6 has an attachment mechanism 7 such as, for example, a magnet to fix the yoke assembly 10 to the mop frame 20 when either pushing or pulling the mop across a surface. As discussed above, for example, the attachment mechanism my additionally or alternatively comprise corresponding male and female engagement portions to releasably fix the yoke assembly to the mop frame. This locking feature (e.g., magnet or structural coupling) prevents the yoke assembly 10 from flipping the mop frame 20 when pushing or pulling the frame in a linear or semi-rotational pattern. Just like a single-sided mop frame, the yoke assembly 10 via the upper joint 6 is fixed to the mop frame to prevent this from happening. In accordance with certain embodiments of the invention, the yoke assembly 10 may comprise a locking device 19 that may be conveniently located to allows the users to lock and grip the handle 5 at one time perpendicular to the mop frame 20 making it easier to attach the wiper to the mop frame (preventing the frame from moving).

In accordance with certain embodiments, the invention provides a cleaning implement comprising (i) a mop frame 20 including a top surface 24 and a bottom surface 26; (ii) a yoke assembly 10 configured to engage and secure a handle portion 5; and (iii) a multi-pivoting hinge 4 attached to and connecting the mop frame and the yoke assemble. In accordance with certain embodiments of the invention, the multi-pivoting hinge 4 may be configured to allow the yoke assembly 10 to selectively (e.g., upon the desire and/or action of a user) swing from the top surface 24 to the bottom surface 26 of the mop frame 20. In accordance with certain embodiments of the invention, the multi-pivoting hinge 4 may comprise a first rotational axis 101, a second rotational axis 102, and a third rotational axis 103, in which upon selectively (e.g., upon the desire and/or action of a user) swinging the yoke assembly 10 from the top surface 24 to the bottom surface 26 or vice versa (i) the third rotational axis 103 remains stationary relative to the mop frame 20, (ii) the second rotational axis 102 rotates about the third rotational axis 103, and (iii) the first rotational axis 101 rotates about the second rotational axis 102. The multi-pivoting hinge 4, in accordance with certain embodiments of the invention, may comprise an upper joint 6 configured to selectively overlie (e.g., directly or indirectly) the top surface 24 and/or the bottom surface 26 of the mop frame 20 depending on the selected position of the yoke assembly 10 relative to the mop frame, in which the upper joint comprises an upper-joint length such that the handle portion 5 is centrally located over the mop frame. In accordance with certain embodiments of the invention, the upper joint may comprise an attachment mechanism 7 configured to releasably engage the yoke assembly 10 to a centrally located portion of the mop frame.

In accordance with certain embodiments of the invention, the multi-pivoting hinge 4 comprised of three (3) rotational axes 101,102,103 and upper joint 6 not only provides at least the scrubbing benefits (e.g., equal distribution of force) associated with single-sided mop frames, but additionally (e.g., simultaneously) provides a double-sided mop frame (e.g., top surface 24 and bottom surface 26 covered with a wiper material and can be used for cleaning). In this regard, the total wiper surface available for cleaning disposed on the mop frame is roughly doubled by utilizing both the top surface 24 and bottom surface 26 of the mop frame. The rotational axes 101,102,103, as illustrated in FIG. 5, extend perpendicular to the page (i.e., into and/or out of the plane of the page). To the contrary, for example, yoke assembly 10 may comprise a rotational axis 109 about which the handle 5 may rotate relative to the yoke joint 3. As illustrated in FIG. 5, the rotational axis 109 lies in the plane of the paper such that the handle may rotate into and/or out of the plane of the paper).

In accordance with certain embodiments of the invention, the top surface 24 and/or the bottom surface 26 of the mop frame 20 may comprise a structure in accordance with any of the single-sided mop frames described and/or illustrated (e.g., FIGS. 1 and 2A-2D) herein. For example, certain embodiments of the invention including the multi-pivoting hinge 4 may comprise top surface 24 and/or bottom surface 26 of the mop frame 20 having a structure in accordance with any of the single-sided mop frames described and/or illustrated (e.g., FIGS. 1 and 2A-2D) herein. In this regard, dual-sided mop frames (e.g., illustrated by FIGS. 3A-3D, 4A-4D, and 5) in accordance with certain embodiments of the invention can include top and/or bottom surfaces including one or more frontal recessed portions and/or one or more rearward recessed portion as discussed and disclosed herein. In this regard, the surfaces of a dual-sided mop frame may comprise the same patterned geometry on top and/or bottom surfaces as those of the single-sided mop frames discussed and disclosed herein. For example, the bottom surface 26 in combination with the front edge 28 and/or rear edge 29 may define a first-set of recessed portions while the top surface 24 in combination with the front edge 28 and/or rear edge 29 may define a second-set of recessed portions. In accordance with certain embodiments of the invention, the first-set of recessed portions may correspond in geometric configuration and/or location along the length (e.g., distance between side edges 27*a*,27*b*) of the mop frame. In accordance with certain embodiments of the invention, the first-set of recessed portions and the second-set of recessed portions by not correspond in location along the length of the mop frame. For example, the location of the first-set of recessed portions may be offset from the location of the second-set of recessed portions such the first-set of recessed portions and the second-set of recessed portions are not perfectly aligned with each other along the length of the mop frame.

In accordance with certain embodiments of the invention, the mop frame may comprise an integrally molded, extruded, or 3D-printed structure (e.g., formed as a single piece of material). Mop frames according to certain embodiments of the invention may comprises a polymer, a biodegradable polymer, a biocomposite, or any combination thereof. In certain embodiments of the invention, the polymer comprises at least one of an extruded thermoplastic polymer, an extruded thermoset polymer, a mold-formed thermoplastic polymer, a mold-formed thermoset polymer, or any combination thereof. In certain embodiments of the invention, the polymer comprises at least one of a polyethylene, a polypropylene, a partially aromatic polyester, a fully aromatic polyester, a polyhexamethylene diadipamide, a polycaprolactam, an aromatic polyamide, a partially aromatic polyamide, an aliphatic polyamide, or any combination thereof. In certain embodiments of the invention, the mop frame comprises a biodegradable polymer, in which the biodegradable polymer comprises at least one of a cellulose, a polylactic acid, a cellophane, a native starch, a thermoplastic starch, a polyhydroxy butyrate, a poly-hydroxybutyrate-co-b-hydroxy valerate, a polyglycolic acid, a polycaprolactone, a compostable bioplastic, a platinum-catalyzed silicone, a reclaimed potato starch resin, or any combination thereof.

III. Method of Manufacturing a Mop Frame

In another aspect, certain embodiments of the invention provide a method for manufacturing a mop frame. According to an embodiment of the invention, the method of manufacturing a mop frame includes an optional step of preparing a flowable polymeric melt composition and forming a substantially flat body portion comprising a central body portion, a top surface, a bottom surface, diametrically opposed side edges, and diametrically opposed front and rear edges in accordance with embodiments of the invention disclosed herein. Certain embodiments of the invention, also comprise a step of forming at least one frontal recessed portion extending from the front edge towards the central body portion, wherein the at least one frontal recessed portion defines a front open area along the length of the front edge, and/or forming at least one rearward recessed portion extending from the rear edge towards the central body portion, wherein the at least one rearward recessed portion defines a rear open area along the length of the rear edge in accordance with embodiments of the invention disclosed herein. In accordance with certain embodiments of the invention, the method may comprise forming at least one retaining structure configured to releasably attach a cleaning fabric (e.g., wiper material) proximate to or adjacent to at least the bottom surface in accordance with embodiments of the invention disclosed herein.

In accordance with certain embodiments of the invention, the step of forming the substantially flat body portion comprises an injection molding process, extrusion process, or a three-dimensional (3D) printing process. In accordance with certain embodiments of the invention, the step of forming the at least one frontal recessed portion, the at least one rearward recessed portion, the at least one retaining structure, or any combination thereof comprises an injection molding process, an extrusion process, or a three-dimensional (3D) printing process. In accordance with certain embodiments of the invention, each of the at least one frontal recessed portion, the at least one rearward recessed portion, the at least one retaining structure may be formed as a single unitary component by an injection molding process, an extrusion process, or a three-dimensional (3D) printing process. In accordance with certain embodiments of the invention, the method may comprise a step of forming a plurality of angular fin projections in which the step of forming each of the plurality of angular fin projections comprises an injection molding process, an extrusion process, or a three-dimensional (3D) printing process. Methods of manufacturing a mop frame, according to certain embodiments of the invention, may comprise filling a die or mold with the flowable polymeric melt composition and curing the flowable polymeric melt composition to provide a solid polymeric composition. In this regard, the mop frame manufactured according to certain embodiments of the invention may comprise a unitary structure (e.g., formed as one single piece and being devoid of any attachment articles such as screws, bolts, clips or the like) or as an assembled structure, in which the individual components may be releasable engaged, such as by screws, bolts, clips and the like, with each other to form an assembled mop frame.

Figure 6:
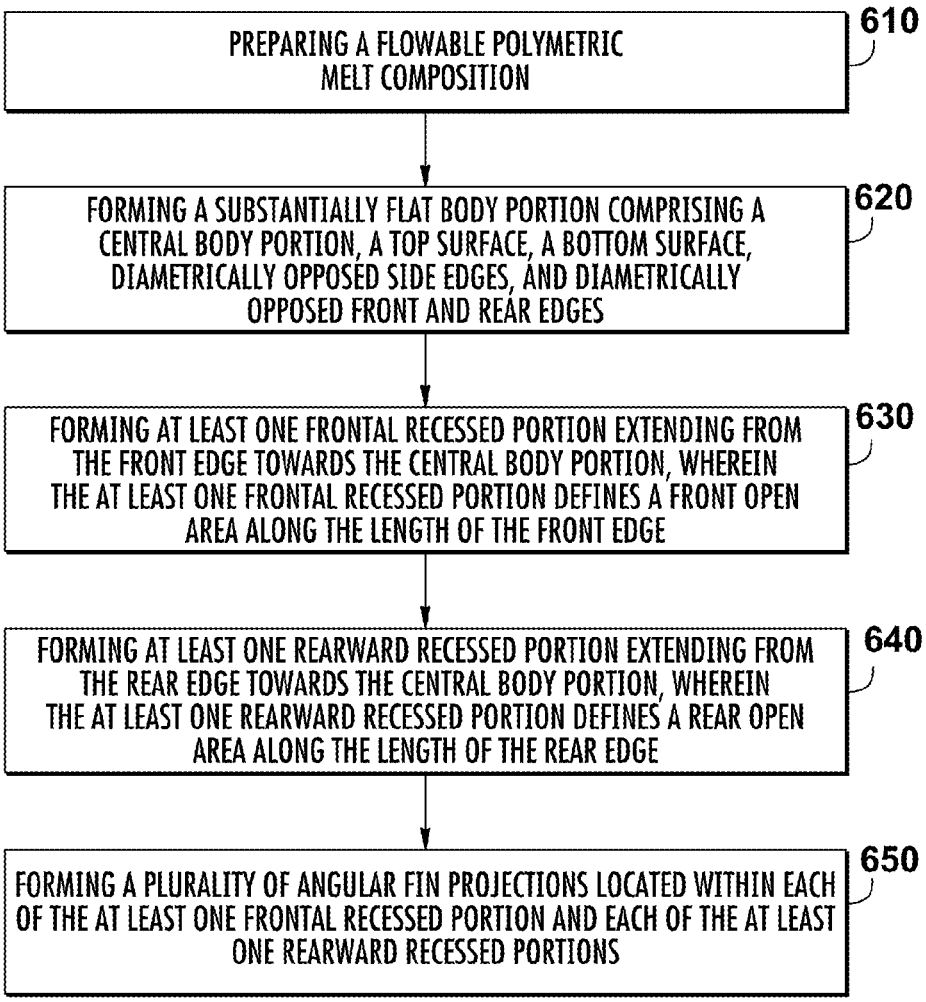
FIG. 6 illustrates a process flow diagram for forming a mop frame according to an embodiment of the invention.

For example, FIG. 6 is a process flow diagram for a method of manufacturing a mop frame according to an embodiment of the invention. As shown in FIG. 6, the exemplary method includes a step of preparing a flowable polymeric melt composition at operation 610, forming a substantially flat body portion comprising a central body portion, a top surface, a bottom surface, diametrically opposed side edges, and diametrically opposed front and rear edges at operation 620, forming at least one frontal recessed portion extending from the front edge towards the central body portion, wherein the at least one frontal recessed portion defines a front open area along the length of the front edge at operation 630, forming at least one rearward recessed portion extending from the rear edge towards the central body portion, wherein the at least one rearward recessed portion defines a rear open area along the length of the rear edge at operation 640, and forming a plurality of angular fin projections located within each of the at least one frontal recessed portions and each of the at least one rearward recessed portions at operation 650. In accordance with certain embodiments of the invention, for instance, methods of manufacturing a mop frame may comprise forming any combination of elements and/or features disclosed herein related to mop frames according to embodiments of the invention. For instance, In accordance with certain embodiments of the invention, the at least one frontal recessed portion may include a first frontal recessed portion and the at least one rearward recessed portions may include a first rearward recessed portion, in which each of the first frontal recessed portion and the first rearward recessed portion comprises a top wall and at least one side wall.

In certain embodiments of the invention, for example, the top wall may be substantially parallel to the bottom surface while in other embodiments the top wall may not be substantially parallel to the bottom surface of the mop frame. Certain embodiments of the invention may comprise at least one side wall (or all side walls) being substantially perpendicular to the bottom surface. In other embodiments of the invention, at least one side wall (or all side walls) may not be substantially perpendicular to the bottom surface of the mop frame. In accordance with certain embodiments of the invention, for example, the at least one frontal recessed portion may comprise a variable cross-section including a first frontal recessed portion cross-section proximate to and parallel with the front edge of the mop frame and a second frontal recessed portion cross-section distal from and parallel with the front edge of the mop frame, in which the first frontal recessed portion cross-section may be larger than the second frontal recessed portion cross-section. Similarly, certain embodiments of the invention may also comprise at least one rearward recessed portion comprising a variable cross-section including a first rearward recessed portion cross-section proximate to and parallel with the rear edge of the mop frame and a second rearward recessed portion cross-section distal from and parallel with the rear edge, in which the first rearward recessed portion cross-section may be larger than the second rearward recessed portion cross-section. In accordance with certain embodiments of the invention, the mop frame may comprise from about 1 to about 10 frontal recessed portions and/or from about 1 to about 10 rearward recessed portions.

In accordance with certain method embodiments to the invention, the front edge of the mop frame may comprise a front edge height defined by a front length extending from the bottom surface of the mop frame to the top surface of the mop frame and the at least one side wall of the first frontal recessed portion defines, at least in part, a first frontal recessed portion depth. In accordance with certain embodiments of the invention, the first frontal recessed portion depth may be less than the front edge height. In addition are alternatively to, certain embodiments of the invention may include a rear edge comprising a rear edge height defined, at least in part, by a rear length extending from the bottom surface of the mop frame to the top surface of the mop frame and the at least one side wall of the first rearward recessed portion defines, at least in part, a first rearward recessed portion depth. In accordance with certain embodiments of the invention, the first rearward recessed portion depth may be less than the rear edge height. According to certain method embodiments of the invention, the produced mop fames may comprise at least a first frontal recessed portion depth comprising a variable depth including an outer depth proximate to the front edge of the mop frame and an inner depth distal from the front edge of the mop frame, in which the outer depth may be larger than the inner depth. The first rearward recessed portion depth, according to certain embodiments of the invention, may comprise a variable depth including an outer depth proximate to the rear edge of the mop frame and an inner depth distal from the rear edge of the mop frame, in which the outer depth may be larger than the inner depth.

According to certain method embodiments of the invention, the produced mop frames may further comprise a plurality of angular fin projections located within at least the first frontal recessed portion and the first rearward recessed portion. In accordance with certain embodiments of the invention, each of the at least one frontal recessed portions and each of the at least one rearward recessed portions may include a plurality of angular fin projections located therein, in which (for example) each of the angular fin projections extend from each corresponding top wall. The plurality of angular fin projections, according to certain embodiments of the invention, located within at least the first frontal recessed portion comprises a first pair (e.g. two complementary arrays of angular fin projections) of arrays configured in a converging pattern. In accordance with certain embodiments of the invention, the pair of arrays includes a first array of individual angular fin projections and a second array of individual angular fin projections, wherein (for example) each of the individual angular fin projections being oriented at an angle from between about 5 to about 85 degrees from a longitudinal axis of the mop frame. The individual angular fin projections of at least the first array, for example, may be equidistantly spaced apart from each other. Each of the plurality of angular fin projections located within at least the first frontal recessed portion and the first rearward recessed portion, according to certain embodiments of the invention, may comprise a base end adjacent the corresponding top wall and extend towards the bottom surface of the mop frame and terminate at a tip end located at or proximate a bottom plane including the bottom surface of the mop frame. In accordance with certain embodiments of the invention, the plurality of angular fin projections may comprise a flexible polymeric material. The plurality of angular fin projections, according to certain embodiments of the invention, may comprise a first thickness at the base end and a second thickness at the tip end, in which the first thickness may be larger than the second thickness.

According to certain method embodiments of the invention, the produced mop frames may comprise at least one retaining structure comprising, for example, a first channel being open in an upwardly facing direction and comprising an open section located at or proximate the top surface of the mop frame. For example, the first channel may be configured for receiving a portion of a cleaning fabric (e.g., a wiper material) and may comprise a first flexible pointed protrusion configured to engage and releasably secure the portion of the cleaning fabric within the first channel. In accordance with certain embodiments, the first flexible pointed protrusion may be located at or proximate the open section of the first channel. In accordance with certain embodiments of the invention, the first channel may be located at or proximate to the front edge of the mop frame. The first channel, according to certain embodiments of the invention, may extend along about 50% to 100% of a longitudinal length of the mop frame. In still further embodiments of the invention, the mop frame may further comprise a second channel being open in an upwardly facing direction and comprising a second open section located at or proximate the top surface. In certain embodiments of the invention, the second channel may be configured for receiving a second portion of the cleaning fabric and comprising a second flexible pointed protrusion configured to engage and releasably secure the second portion of the cleaning fabric within the second channel. In accordance with certain embodiments of the invention, the second flexible pointed protrusion may be located at or proximate the second open section of the second channel. In accordance with certain embodiments of the invention, the second channel may be located at or proximate to the rear edge of the mop frame and the second channel may extend along about 50% to 100% of the longitudinal length of the mop frame.

According to certain method embodiments of the invention, the produced mop frames including at least one retaining structure, the at least one retaining structure may comprise a first channel being open in a frontward facing direction and comprising an open section located at the front edge of the mop frame, in which the first channel may be configured for receiving a portion of a cleaning fabric (e.g., a wiper material) and comprising a first flexible pointed protrusion configured to engage and releasably secure the portion of the cleaning fabric within the first channel. In accordance with certain embodiments of the invention, the first channel may extend along about 50% to 100% of a longitudinal length of the mop frame. In accordance with certain embodiments of the invention, the first flexible pointed protrusion may be located at or proximate the open section of the first channel. According to still further embodiments of the invention, the at least one retaining structure may further comprise a second channel being open in a rearward facing direction and comprising a second open section located at the rear edge of the mop frame. The second channel, according to certain embodiments of the invention, may be configured for receiving a second portion of the cleaning fabric and comprise a second flexible pointed protrusion configured to engage and releasably secure the second portion of the cleaning fabric within the second channel. In accordance with certain embodiments of the invention, the second channel may extend along about 50% to 100% of the longitudinal length of the mop frame. In accordance with certain embodiments of the invention, the second flexible pointed protrusion may be located at or proximate the second open section of the second channel.

According to certain method embodiments of the invention, the produced mop frames may comprise at least one retaining structure comprising a generally S-shaped channel structure. The S-shaped channel structure, for example, may comprise a first open section located at or proximate the top surface of the mop frame and facing in an upwardly direction and a second open section located at or proximate the bottom surface of the mop frame and facing in an downwardly direction. In accordance with certain embodiments of the invention, the generally S-shaped channel structure may be configured to releasably secure a first portion of a cleaning fabric (e.g., a wiper material) within the first open section and releasably secure a second portion of a cleaning fabric within the second open section.

According to certain embodiments of the invention, for instance, the mop frame (or a portion thereof) may comprise at least one of a polymer, a biodegradable polymer, a biocomposite, or any combination thereof. In some embodiments of the invention, for example, the polymer may comprise at least one of an extruded thermoplastic polymer, an extruded thermoset polymer, a mold-formed thermoplastic polymer, a mold-formed thermoset polymer, or any combination thereof. In further embodiments of the invention, for instance, the polymer may comprise at least one of a polyethylene, a polypropylene, a partially aromatic polyester, a fully aromatic polyester, a polyhexamethylene diadipamide, a polycaprolactam, an aromatic polyamide, a partially aromatic polyamide, an aliphatic polyamide, or any combination thereof. In some embodiments of the invention, for example, the biodegradable polymer may comprise at least one of a cellulose, a polylactic acid, a cellophane, a native starch, a thermoplastic starch, a polyhydroxy butyrate, a poly-hydroxybutyrate-co-b-hydroxy valerate, a polyglycolic acid, a polycaprolactone, a compostable bioplastic, a platinum-catalyzed silicone, a reclaimed potato starch resin, or any combination thereof.

These and other modifications and variations to the invention may be practiced by those of ordinary skill in the art without departing from the spirit and scope of the invention, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the invention as further described in such appended claims. Therefore, the spirit and scope of the appended claims should not be limited to the exemplary description of the versions contained herein.

That which is claimed:

1. A mop frame, comprising:

a central body portion, a top surface, a bottom surface, diametrically opposed side edges, and diametrically opposed front and rear edges, wherein the front and rear edges are longer than the side edges;

at least one frontal recessed portion defined by the front edge and the bottom surface, the at least one frontal recessed portion extends from the front edge towards the central body portion, wherein the at least one frontal recessed portion defines a front open area along at least a portion of the front edge;

at least one rearward recessed portion defined by the rear edge and the bottom surface, the at least one rearward recessed portion extends from the rear edge towards the central body portion, wherein the at least one rearward recessed portion defines a rear open area along at least a portion of the rear edge;

at least one retaining structure configured to releasably attach a fabric proximate to or adjacent to at least the bottom surface;

wherein the at least one frontal recessed portion comprises a variable cross-section including a first frontal recessed portion cross-section proximate to and parallel with the front edge and a second frontal recessed portion cross-section distal from and parallel with the front edge; the first frontal recessed portion cross-section being larger than the second frontal recessed portion cross-section.

2. The mop frame according to claim 1, wherein the at least one frontal recessed portion includes a first frontal recessed portion and the at least one rearward recessed portions includes a first rearward recessed portion; each of the first frontal recessed portion and the first rearward recessed portion comprises a top wall and at least one side wall.

3. The mop frame according to claim 2, further comprising a plurality of angular fin projections located within at least (i) the first frontal recessed portion and (ii) the first rearward recessed portion.

4. The mop frame according to claim 3, wherein each of the at least one frontal recessed portion and each of the at least one rearward recessed portions include a plurality of angular fin projections located therein; each of the angular fin projections extend from each corresponding top wall.

5. The mop frame according to claim 4, wherein the plurality of angular fin projections located within at least the first frontal recessed portion comprises a first pair of arrays configured in a converging pattern.

6. The mop frame according to claim 5, wherein the pair of arrays includes a first array of individual angular fin projections and a second array of individual angular fin projections; each of the individual angular fin projections being oriented at an angle from between about 5 to about 85 degrees from a longitudinal axis of the mop frame.

7. The mop frame according to claim 1, wherein the at least one rearward recessed portion comprises a variable cross-section including a first rearward recessed portion cross-section proximate to and parallel with the rear edge and a second rearward recessed portion cross-section distal from and parallel with the rear edge; the first rearward recessed portion cross-section being larger than the second rearward recessed portion cross-section.

8. The mop frame according to claim 1, wherein (i) the bottom surface, the front edge, and the rear edge define a first-set of recessed portions comprising the at least one frontal recessed portion and the at least one rearward recessed portion and (ii) the top surface, the front edge, and the rear edge define a second-set of recessed portions.

9. The mop frame according to claim 8, wherein the first-set of recessed portions and the second set of recessed portions comprise the same geometric configuration.

10. The mop frame according to claim 8, wherein the first-set of recessed portions and the second set of recessed portions are aligned with each other along a length of the mop frame.

11. The mop frame according to claim 8, wherein the first-set of recessed portions and the second set of recessed portions are offset from each other along a length of the mop frame.

12. The mop frame according to claim 1, wherein the at least one retaining structure comprises a generally S-shaped channel structure comprising (i) a first open section located at or proximate the top surface and facing in an upwardly direction and (ii) a second open section located at or proximate the bottom surface and facing in an downwardly direction; the generally S-shaped channel structure being configured to releasably secure a first portion of the fabric within the first open section and releasably secure a second portion of the fabric within the second open section.

13. The mop frame according to claim 1, wherein the at least one retaining structure comprises a first channel being open in a frontward facing direction and comprising an open section located at the front edge of the mop frame; the first channel being configured for receiving a portion of a the fabric and comprising a first flexible pointed protrusion configured to engage and releasably secure the portion of the fabric within the first channel; wherein the first flexible pointed protrusion is located at or proximate the open section of the first channel.

14. The mop frame according to claim 1, wherein the at least one frontal recessed portion comprises a plurality of individual recessed portions.

15. The mop frame according to claim 14, wherein the at least one frontal recessed portion comprises from 3 to 30 frontal recessed portions.

16. A mop frame, comprising:

a central body portion, a top surface, a bottom surface, diametrically opposed side edges, and diametrically opposed front and rear edges, wherein the front and rear edges are longer than the side edges;

at least one frontal recessed portion defined by the front edge and the bottom surface, the at least one frontal recessed portion extends from the front edge towards the central body portion, wherein the at least one frontal recessed portion defines a front open area along at least a portion of the front edge;

at least one rearward recessed portion defined by the rear edge and the bottom surface, the at least one rearward recessed portion extends from the rear edge towards the central body portion, wherein the at least one rearward recessed portion defines a rear open area along at least a portion of the rear edge;

at least one retaining structure configured to releasably attach a fabric proximate to or adjacent to at least the bottom surface;

wherein the at least one retaining structure comprises a first channel being open in an upwardly facing direction and comprising an open section located at or proximate the top surface; the first channel being configured for receiving a portion of a the fabric and comprising a first flexible pointed protrusion configured to engage and releasably secure the portion of the fabric within the first channel; wherein the first flexible pointed protrusion is located at or proximate the open section of the first channel.

17. The mop frame according to claim 16, wherein the first channel is located at or proximate to the front edge of the mop frame.

18. A cleaning implement, comprising:

(a) a mop frame including a central body portion, a top surface, a bottom surface, diametrically opposed side edges, and diametrically opposed front and rear edges, wherein the front and rear edges are longer than the side edges, and wherein the mop frame further comprises at least one frontal recessed portion defined by the front edge and the bottom surface, the at least one frontal recessed portion extends from the front edge towards the central body portion, wherein the at least one frontal recessed portion defines a front open area along at least a portion of the front edge; and wherein the at least one frontal recessed portion comprises a variable cross-section including a first frontal recessed portion cross-section proximate to and parallel with the front edge and a second frontal recessed portion cross-section distal from and parallel with the front edge; the first frontal recessed portion cross-section being larger than the second frontal recessed portion cross-section;

(b) a yoke assembly configured to engage and secure a handle portion; and (c) a multi-pivoting hinge attached to and connecting the mop frame and the yoke assemble, the multi-pivoting hinge being configured to allow the yoke assembly to selectively swing from the top surface to the bottom surface of the mop frame.

19. The cleaning implement according to claim 18, wherein the multi-pivoting hinge comprises a first rotational axis, a second rotational axis, and a third rotational axis; and wherein upon selectively swinging the yoke assembly from the top surface to the bottom surface or vice versa (i) the third rotational axis remains stationary relative to the mop frame, (ii) the second rotational axis rotates about the third rotational axis, and (iii) the first rotational axis rotates about the second rotational axis.

20. The cleaning implement according to claim 18, wherein the multi-pivoting hinge comprises an upper joint configured to selectively overlie the top surface or the bottom surface of the mop frame, the upper joint comprises an upper-joint length such that the handle portion is centrally located over the mop frame.

21. The cleaning implement according to claim 20, wherein the upper joint comprises an attachment mechanism configured to releasably engage the yoke assembly to a centrally located portion of the mop frame.

* * * * *